US009247349B2

(12) United States Patent
Saiki et al.

(10) Patent No.: US 9,247,349 B2
(45) **Date of Patent: *Jan. 26, 2016**

(54) LOUDSPEAKER, VIDEO DEVICE, AND PORTABLE INFORMATION PROCESSING APPARATUS

(71) Applicant: Panasonic Intellectual Property Management Co., Ltd., Osaka (JP)

(72) Inventors: Shuji Saiki, Nara (JP); Hiroyuki Takewa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/927,332

(22) Filed: Jun. 26, 2013

(65) Prior Publication Data

US 2013/0294640 A1 Nov. 7, 2013

Related U.S. Application Data

(62) Division of application No. 12/523,201, filed as application No. PCT/JP2008/003074 on Oct. 28, 2008, now Pat. No. 8,542,861.

(30) Foreign Application Priority Data

Nov. 20, 2007 (JP) ..... 2007-300129

(51) Int. Cl.
*H04R 1/00* (2006.01)
*H04R 9/02* (2006.01)
(Continued)

(52) U.S. Cl.
CPC ..... *H04R 9/027* (2013.01); *H04R 7/20* (2013.01); *H04R 9/043* (2013.01); *H04R 7/04* (2013.01);
(Continued)

(58) Field of Classification Search
USPC ..... 381/423, 431, 433, 396, 412
See application file for complete search history.

(56) References Cited

U.S. PATENT DOCUMENTS 4,152,552 A * 5/1979 Meyer ..... H04R 1/30 181/159
5,231,672 A 7/1993 Tsao
(Continued)

FOREIGN PATENT DOCUMENTS

CN 1356851 7/2002
JP 36-28406 10/1961
(Continued)

OTHER PUBLICATIONS

International Search Report mailed Feb. 24, 2009 for International Application No. PCT/JP2008/003074.
(Continued)

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A loudspeaker includes a diaphragm that vibrates back and forth to emit a sound, a magnetic circuit that is provided on a rear side of the diaphragm and has a magnetic gap on a diaphragm side, and a voice coil that is directly or indirectly joined to the diaphragm and disposed within the magnetic gap. A magnetic fluid is loaded within the magnetic gap. Also, a plurality of first edge pieces are provided at different positions in an outer circumferential portion of the diaphragm for vibratably supporting the diaphragm, each of the first edge pieces having a non-linear cross-sectional shape.

17 Claims, 15 Drawing Sheets

(51) Int. Cl.

| | |
|---|---|
| ***H04R 7/20*** | (2006.01) |
| *H04R 9/04* | (2006.01) |
| *H04R 9/06* | (2006.01) |
| *H04R 7/04* | (2006.01) |
| *H04R 7/24* | (2006.01) |

(52) U.S. Cl.
CPC . *H04R 7/24* (2013.01); *H04R 9/022* (2013.01); *H04R 9/047* (2013.01); *H04R 9/06* (2013.01); *H04R 2231/003* (2013.01); *H04R 2307/207* (2013.01)

(56) References Cited

U.S. PATENT DOCUMENTS

| | | | | |
|---|---|---|---|---|
| 5,263,093 | A * | 11/1993 | Nakamura et al. | 381/357 |
| 5,335,287 | A | 8/1994 | Athanas | |
| 6,804,368 | B2 | 10/2004 | Tsuda | |
| 7,020,301 | B2 | 3/2006 | Koura et al. | |
| 7,483,545 | B2 | 1/2009 | Nagaoka | |
| 7,881,490 | B2 | 2/2011 | Chiba et al. | |
| 8,259,987 | B2 * | 9/2012 | Omoda | H04R 7/14 181/171 |
| 8,542,861 | B2 * | 9/2013 | Saiki et al. | 381/398 |
| 2002/0071591 | A1 | 6/2002 | Han et al. | |
| 2002/0144858 | A1 * | 10/2002 | Toyoda | 181/166 |
| 2004/0234096 | A1 | 11/2004 | Tsuda | |
| 2005/0079904 | A1 | 4/2005 | Hussaini et al. | |
| 2005/0157900 | A1 * | 7/2005 | Litovsky et al. | 381/349 |
| 2008/0285787 | A1 | 11/2008 | Szu-Wei | |
| 2010/0158304 | A1 * | 6/2010 | Reinecke | 381/396 |
| 2011/0051987 | A1 * | 3/2011 | Ueda et al. | 381/412 |

FOREIGN PATENT DOCUMENTS

| | | |
|---|---|---|
| JP | 55-053996 | 4/1980 |
| JP | 56-058398 | 5/1981 |
| JP | 61-267499 | 11/1986 |
| JP | 6-29298 | 4/1994 |
| JP | 2004-274206 | 9/2004 |

OTHER PUBLICATIONS

Informal Comments made by Applicant to Written Opinion of the International Searching Authority transmitted on Feb. 24, 2009.

* cited by examiner

LOUDSPEAKER, VIDEO DEVICE, AND PORTABLE INFORMATION PROCESSING APPARATUS

TECHNICAL FIELD

The present invention relates to a loudspeaker, a video device including the loudspeaker, and a portable information processing apparatus including the loudspeaker, and more particularly to a small-size loudspeaker capable of wideband reproduction, a video device including the loudspeaker, and a portable information processing apparatus including the loudspeaker.

BACKGROUND ART

Recently, particularly in mobile phones among portable information processing apparatuses, sets are being downsized and thinned with multi-functionalization such as installation of cameras, stereo reproduction of ringtone melodies, and the like, and with size increase of liquid crystal screens. This makes it difficult to obtain a space for placing a loudspeaker within a mobile phone set, and there is a demand for downsizing a receiver which is a loudspeaker for reproducing a reception sound of a mobile phone and downsizing a micro loudspeaker for reproducing a ringtone and/or a music signal.

In addition, not only mobile phones but also video devices, such as flat-screen televisions, including PDPs (Plasma Display Panels), liquid crystal panels, or the like are desired to be further thinned and frame-narrowed by narrowing outer frames enclosing the PDPs or the liquid crystal panels to a maximum extent in order to make screens appear larger according to a design demand. Therefore, loudspeakers installed in the flat-screen televisions are also desired to have small and slim shapes with narrow widths.

Further, in a receiver of a mobile phone, for example, as a mobile phone system advances from the third generation to the fourth generation, expansion of a low frequency range for a wider reproduction range is also desired.

As described above, downsizing and widening of a reproduction range are demanded in loudspeakers of mobile phones and flat-screen televisions.

In a conventional loudspeaker structure, however, downsizing causes a support (an edge, a damper, and the like) which vibratably supports a diaphragm to be reduced in width and accordingly to be increased in stiffness. As a result, the lowest resonance frequency of the loudspeaker becomes higher to fail to expand a low frequency range, which makes it difficult to widen a reproduction range. Thus, in the conventional loudspeaker structure, it is difficult to realize both downsizing and widening of a reproduction range.

As one of prior arts for solving this problem, a loudspeaker disclosed in Patent Document 1 has been proposed. FIG. 15 is a structure section of a conventional loudspeaker disclosed in Patent Document 1. In FIG. 15, a loudspeaker includes a yoke 1, a magnet 2, a plate 3, a voice coil 4, a diaphragm 5, a butterfly damper 6, a magnet 7, and a magnetic fluid 8.

The magnet 2 is fixed to an inner bottom surface of the yoke 1 which has a box-like shape with an upper surface thereof opened. The plate 3 is fixed to an upper surface of the magnet 2. A magnetic gap G1 is formed between the yoke 1 and the plate 3. Thus, the yoke 1, the magnet 2, and the plate 3 constitute a magnetic circuit having the magnetic gap G1. The voice coil 4 is provided on the outer circumference of the diaphragm 5 and positioned within the magnetic gap G1. The butterfly damper 6 is a support that vibratably supports the diaphragm 5, and provided on the outer circumference of the diaphragm 5. The magnet 7 is provided on the outer circumference of the diaphragm 5. The magnetic fluid 8, which is held by magnetic force of the magnet 7, vibrates the diaphragm 5 in a stable manner because of its viscosity.

Operations and effects of the loudspeaker shown in FIG. 15 and configured as above will be described. When a music signal is applied to the voice coil 4, the diaphragm 5 vibrates and a sound is emitted from the diaphragm 5. Here, the stiffness of the butterfly damper 6 is, because of a structure thereof, smaller than the stiffness of an ordinary support (an edge, a damper, and the like). Therefore, in the loudspeaker shown in FIG. 15, even when the loudspeaker is downsized, the lowest resonance frequency of the loudspeaker can be lowered to enable a reproduction range to be widened.

Further, even when the loudspeaker is downsized so that the width of the butterfly damper 6 is reduced, the butterfly damper 6 can show high stroke performance by increasing a length of a joint portion of the butterfly damper 6. Therefore, in the loudspeaker shown in FIG. 15, non-linear distortion by the support, which is caused in the case of large amplitude of the diaphragm 5, can be reduced.

As described above, the loudspeaker shown in FIG. 15 realizes both of downsizing of the loudspeaker and widening of a reproduction range, and moreover reduces non-linear distortion by the support.

Patent Document 1: Japanese Laid-Open Patent Publication No. 2004-274206

SUMMARY OF THE INVENTION

Problems to be Solved by the Invention

However, in the loudspeaker shown in FIG. 15, resonance is likely to occur in the butterfly damper 6 because the joint portion of the butterfly damper 6 has a plate shape. There is a problem that, when the butterfly damper 6 resonates, reproduction sound pressure level/frequency characteristics show large peaks and troughs as shown in FIG. 5 of Patent Document 1, which deteriorates sound quality.

Further, in the loudspeaker shown in FIG. 15, a vibration system is provided with the magnet 7 used exclusively for holding the magnetic fluid 8 by the magnetic force. Thus, there is also a problem that the weight of the vibration system increases by the weight of the magnet 7, which causes an efficiency drop.

Therefore, an object of the present invention is to provide a loudspeaker capable of realizing both of downsizing and widening of a reproduction range and reducing non-linear distortion by a support as well as further improving a sound quality and efficiency, a video device including the loudspeaker, and a portable information processing apparatus including the loudspeaker.

Solution to the Problems

To solve the conventional problems, a loudspeaker according to the present invention comprises: a diaphragm that vibrates back and forth to emit a sound; a magnetic circuit that is provided on a rear side of the diaphragm and has a magnetic gap on a diaphragm side; a voice coil that is directly or indirectly joined to the diaphragm and disposed within the magnetic gap; a magnetic fluid that is loaded within the magnetic gap; and a plurality of first edge pieces that are provided at different positions in an outer circumferential portion of the diaphragm for vibratably supporting the diaphragm, each of the first edge pieces having a non-linear cross-sectional shape.

According to the structure described above, a support that vibratably supports the diaphragm is formed by the plurality of edge pieces which are provided at the different positions in the outer circumferential portion of the diaphragm and each of which has a non-linear cross-sectional shape. As a result, even when the loudspeaker is downsized, the support has the reduced stiffness so that the lowest resonance frequency of the loudspeaker can be lowered to enable a reproduction range to be widened. Moreover, since a cross-sectional shape of the first edge piece is a non-linear shape, non-linear distortion by the support can be reduced. Further, unlike the conventional loudspeaker, there is no need for using the butterfly damper 6 and the magnet 7, and therefore a sound quality and efficiency can be improved. Further, unlike the conventional loudspeaker, the magnetic fluid is loaded within the magnetic gap, and therefore it is possible to prevent burn-out of the voice coil which may be caused upon a large input and to suppress rolling motions of the voice coil so that the voice coil can vibrate in a stable manner.

Preferably, the diaphragm and each of the first edge pieces are formed integrally with each other. Alternatively, the diaphragm and each of the first edge pieces may be formed as separate pieces. Preferably, a cross-sectional shape of each of the first edge pieces is a curved shape or a corrugated shape. Preferably, a cross-sectional shape of the diaphragm is convex toward a front of the diaphragm. Alternatively, a cross-sectional shape of the diaphragm may be a linear shape. In this case, it may further be possible that a rib is formed on the diaphragm.

Preferably, the magnetic circuit includes: a yoke that has a box-like shape with its face on the diaphragm side being opened; a magnet that is fixed to an inner bottom surface of the yoke; and a plate that is fixed to a face of the magnet on the diaphragm side and cooperates with the yoke to form the magnetic gap therebetween; the magnetic fluid is loaded within the magnetic gap at least on an inner circumference side of the voice coil; and a hole is formed in the yoke, the magnet, and the plate so as to extend through the yoke, the magnet, and the plate.

Preferably, a relationship of $f2/f1 \leq 2$ is satisfied where f1 represents the lowest resonance frequency of the loudspeaker without the magnetic fluid being loaded within the magnetic gap and f2 represents the lowest resonance frequency of the loudspeaker with the magnetic fluid being loaded within the magnetic gap.

Preferably, an end of each of the first edge pieces, which is joined to the outer circumferential portion of the diaphragm, is positioned inside an outer circumferential end of the diaphragm.

Preferably, an outer shape of the diaphragm seen from a front side thereof is a rectangular shape, and the first edge pieces are provided at either one of two pairs of opposed sides of the diaphragm. In this case, further preferably, the outer shape of the diaphragm is a rectangle, and the first edge pieces are provided at two short sides of the diaphragm.

Alternatively, it is advantageous that: the magnetic circuit includes: a yoke that is formed with a box-like shape with its face on the diaphragm side being opened and whose outer shape is a rectangular shape when seen from a front side of the diaphragm; a magnet that is fixed to an inner bottom surface of the yoke; and a plate that is fixed to a face of the magnet on the diaphragm side and cooperates with the yoke to form the magnetic gap therebetween; and first side walls of the yoke, which are opposed respectively to a pair of sides of the diaphragm at which the first edge pieces are not provided, are higher than second side walls of the yoke, which are opposed respectively to a pair of sides of the diaphragm at which the first edge pieces are provided. In this case, further advantageously, the loudspeaker further comprises a protector that is provided on the first side walls of the yoke so as to cover the front side of the diaphragm with interposition of a gap.

Preferably, the loudspeaker further comprises: a voice coil bobbin that is joined to the diaphragm for positioning the voice coil within the magnetic gap; and a plurality of second edge pieces that are provided at different positions on an outer circumference of the voice coil bobbin for vibratably supporting the voice coil bobbin, each of the second edge pieces having a non-linear cross-sectional shape.

Preferably, the voice coil is directly joined to the diaphragm; the magnetic fluid is loaded within the magnetic gap at least on an inner circumference side of the voice coil; and an inner shape of the voice coil seen from a front side of the diaphragm is a rectangular shape with corners rounded at a radius of 1 mm or larger.

Preferably, the magnetic circuit includes: a yoke that has a box-like shape with its face on the diaphragm side being opened; a magnet that is fixed to an inner bottom surface of the yoke; and a plate that is fixed to a face of the magnet on the diaphragm side and cooperates with the yoke to form the magnetic gap therebetween; the magnetic fluid is loaded within the magnetic gap on inner and outer circumference sides of the voice coil; and an air hole is formed in the yoke so as to pass air between outside of the yoke and a space that is formed within the yoke by being enclosed by the yoke, the magnet, the plate, the magnetic fluid, and the voice coil.

The present invention is also directed to a video device and a portable information processing apparatus, and the video device and the portable information processing apparatus according to the present invention comprise the above-described loudspeaker according to the present invention and a housing for the loudspeaker to be disposed therein.

Effect of the Invention

According to the present invention, there can be provided a loudspeaker capable of realizing both of downsizing and widening of a reproduction range and reducing non-linear distortion by a support as well as further improving a sound quality and efficiency, a video device including the loudspeaker, and a portable information processing apparatus including the loudspeaker.

DESCRIPTION OF THE REFERENCE CHARACTERS

Figure 1:
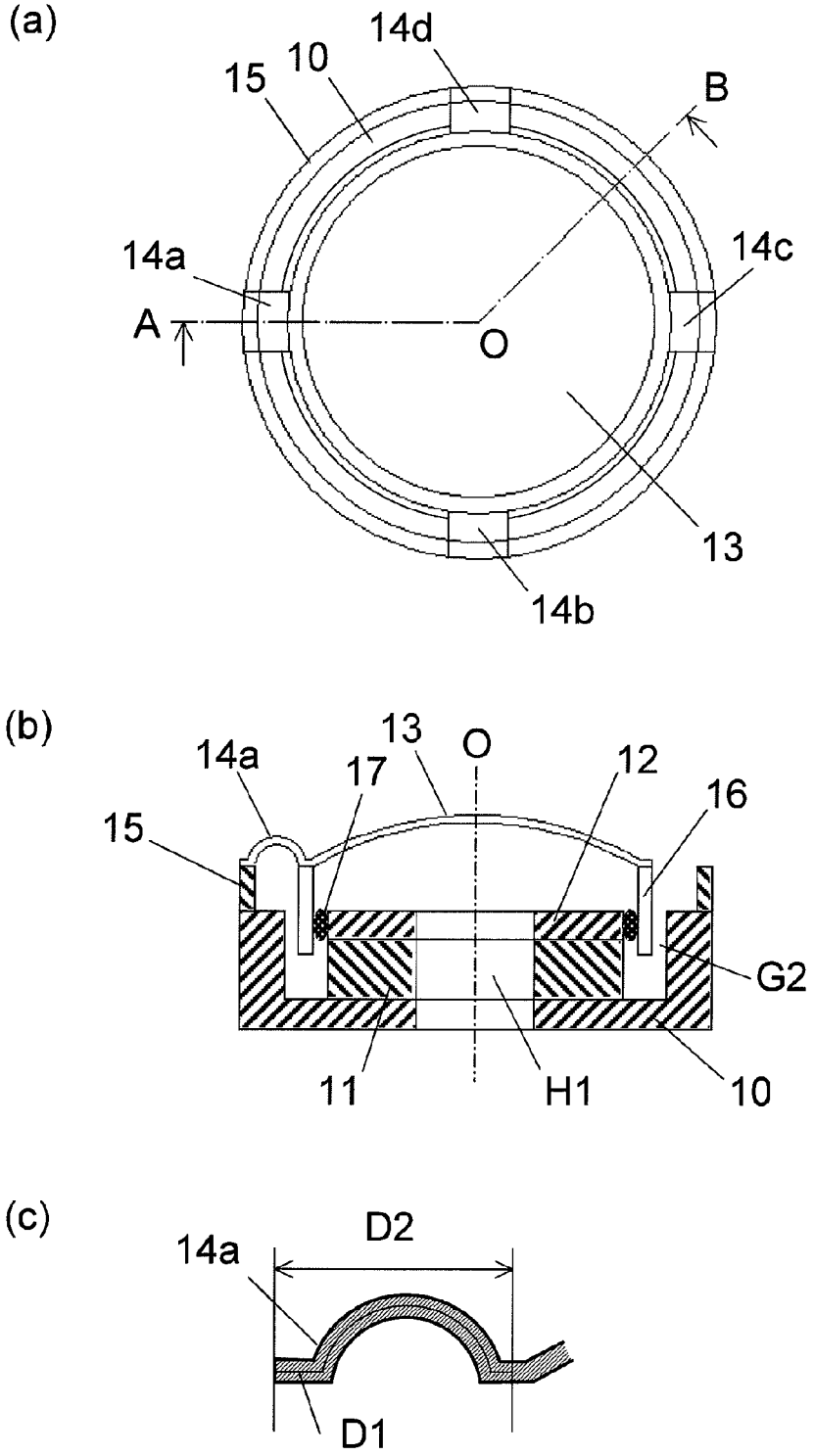
FIGS. 1(*a*)-1(*c*) show a structural example of a loudspeaker according to Embodiment 1.

1, 10, 20, 60 yoke
2, 11, 21, 80 magnet
3, 12, 22, 81 plate
4, 16, 26, 71, 83 voice coil
5, 13, 23, 30, 50, 82 diaphragm
6 butterfly damper
7 magnet
8, 17, 27 magnetic fluid
14*a*-14*d*, 24*a*, 24*b*, 40*a*, 40*b*, 51*a*-51*h*, 62*a*-62*d*, 72*a*, 72*b* edge piece
15, 25, 73, 74 spacer
61 protector
70 voice coil bobbin
90 upper housing
91 lower housing
92 hinge section
93 liquid crystal screen
94, 102 loudspeaker
100 housing
101 display section

DETAILED DESCRIPTION OF THE INVENTION

Hereinafter, embodiments of the present invention will be described with reference to the drawings.

Embodiment 1

A structure of a loudspeaker according to Embodiment 1 of the present invention will be described with reference to FIGS. 1(*a*)-1(*c*). FIGS. 1(*a*)-1(*c*) show a structural example of the loudspeaker according to Embodiment 1. FIG. 1(*a*) is a front view of the loudspeaker, FIG. 1(*b*) shows a structure section of the loudspeaker as cut along the line A-O-B and seen in the arrowed direction in FIG. 1(*a*), and FIG. 1(*c*) is an enlarged view of a structure section of an edge piece 14*a* shown in FIG. 1(*b*).

Referring to FIGS. 1(*a*)-1(*c*), the loudspeaker according to the present embodiment includes a yoke 10, a magnet 11, a plate 12, a diaphragm 13, edge pieces 14*a* to 14*d*, a spacer 15, a voice coil 16, and a magnetic fluid 17. As shown in FIG. 1(*a*), the outer shape of the loudspeaker according to the present embodiment is a circular shape when seen from a front side thereof. Accordingly, the outer shapes of the yoke 10, the magnet 11, the plate 12, the diaphragm 13, and the voice coil 16 on a front side thereof are also circular shapes.

As shown in FIG. 1(*b*), the magnet 11 is fixed to an inner bottom surface of the yoke 10 which has a box-like shape with an upper surface thereof opened. The plate 12 is fixed to an upper surface of the magnet 11. A magnetic gap G2 is formed between the yoke 10 and the plate 12. Thus, the yoke 10, the magnet 11, and the plate 12 constitute a magnetic circuit having the magnetic gap G2. A sound hole H1 is formed in the yoke 10, the magnet 11, and the plate 12 so as to extend along a central axis O through the yoke 10, the magnet 11, and the plate 12.

As shown in FIG. 1(*b*), a cross-sectional shape of the diaphragm 13 is a curved-surface shape and convex upward (frontward). As a result of the cross-sectional shape of the diaphragm 13 being convex, the rigidity of the diaphragm 13 increases. The edge pieces 14*a* to 14*d* are provided at an outer circumferential portion of the diaphragm 13, as a support that vibratably supports the diaphragm 13. The edge pieces 14*a* to 14*d* are made of the same material as that of the diaphragm 13, and formed integrally with the diaphragm 13. As a result of the edge pieces 14*a* to 14*d* being formed integrally with the diaphragm 13, the number of components and assembling man-hours for the loudspeaker can be reduced. The edge pieces 14*a* to 14*d* are members corresponding to parts of a normal edge that is formed throughout the outer circumferential portion of the diaphragm 13. In an example shown in FIG. 1(*a*), a part of the edge having one end thereof joined to a left-side outer circumferential end of the diaphragm 13 is the edge piece 14*a*, a part of the edge having one end thereof joined to a lower outer circumferential end of the diaphragm 13 is the edge piece 14*b*, a part of the edge having one end thereof joined to a right-side outer circumferential end of the diaphragm 13 is the edge piece 14*c*, and a part of the edge having one end thereof joined to an upper outer circumferential end of the diaphragm 13 is the edge piece 14*d*. A cross-sectional shape of each of the edge pieces 14*a* to 14*d* is a curved shape, that is, a non-linear shape. The other end of each of the edge pieces 14*a* to 14*d* is located on an upper surface of a side wall of the yoke 10 via the spacer 15.

Here, the "non-linear shape" mentioned above means not being a linear shape. In other words, referring to an example shown in FIG. 1(*c*), it means satisfying a relationship of D1>D2 where D1 represents a length of a cross section of the edge piece 14*a* and D2 represents the width of the edge piece 14*a*.

The voice coil 16 is provided at the outer circumferential portion of the diaphragm 13 and positioned within the magnetic gap G2. In addition to the voice coil 16, the magnetic fluid 17 is also loaded in the magnetic gap G2. The magnetic fluid 17 holds the voice coil 16 within the magnetic gap G2 by means of its viscosity, to vibrate the voice coil 16 in a stable manner. In the present embodiment, the magnetic fluid 17 is loaded only on an inner circumference side of the voice coil 16 within the magnetic gap G2.

Operations and effects of the loudspeaker configured as above will be described. When a music signal is applied to the voice coil 16, the diaphragm 13 vibrates back and forth (in an up and down direction in FIG. 1(*b*)) and a sound is emitted from the diaphragm 13. A sound from a rear surface of the diaphragm 13 is emitted through the sound hole H1. Here, the support of the present embodiment is made up of the edge pieces 14*a* to 14*d* each having a curved cross-sectional shape. As a result, the stiffness of the support of the present embodiment is smaller than the stiffness of the normal edge formed throughout the outer circumferential portion of the diaphragm 13. Therefore, in the loudspeaker according to the present embodiment, even when the loudspeaker is downsized, the lowest resonance frequency of the loudspeaker can be lowered to enable a reproduction range to be widened.

Further, since each of the edge pieces 14*a* to 14*d* has a curved cross-sectional shape, linearity against large amplitude of the diaphragm 13 can be ensured even when the loudspeaker is downsized, so that the width of each of the edge pieces 14*a* to 14*d* (corresponding to D2 in (c) of FIG. 1) is reduced. Therefore, in the loudspeaker according to the present embodiment, even when the loudspeaker is downsized, non-linear distortion by the support, which is caused in the case of large amplitude of the diaphragm 13, can be reduced. Here, the magnetic fluid 17 is merely held by magnetic force within the magnetic gap G2, and does not restrict a vibration of the voice coil 16 even when the voice coil 16 shows large amplitude.

Figure 15:
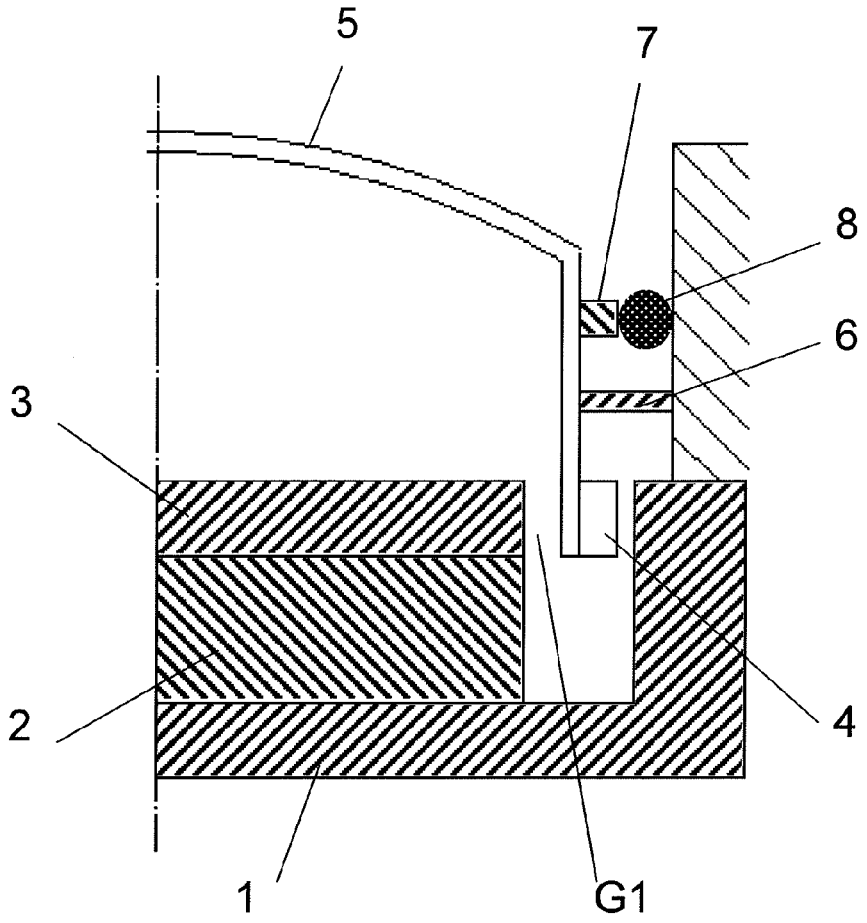
FIG. 15 shows a structure section of a conventional loudspeaker disclosed in Patent Document 1.

Further, unlike a conventional loudspeaker shown in FIG. 15, the loudspeaker according to the present embodiment does not adopt the butterfly damper 6 and the magnet 7. Therefore, deterioration in sound quality which may be caused by resonance of the butterfly damper 6 and an efficiency drop which may be caused by the magnet 7 do not occur, and a sound quality and efficiency can be improved as compared with the conventional loudspeaker shown in FIG. 15.

As described above, according to the present embodiment, there can be provided the loudspeaker capable of realizing both of downsizing and widening of a reproduction range and reducing non-linear distortion by the support as well as further improving a sound quality and efficiency.

In addition, in the present embodiment, unlike in the conventional loudspeaker, the magnetic fluid 17 is loaded within the magnetic gap G2. As a result, heat generation of the voice coil 16 can be suppressed by a cooling effect of the magnetic fluid 17, and burnout of the voice coil 16 which may be caused upon a large input can be prevented.

Moreover, in the present embodiment, unlike in the conventional loudspeaker, the sound hole H1 is formed. This can prevent the lowest resonance frequency of the loudspeaker from becoming higher because of the air stiffness of a space that exists on the rear surface of the diaphragm 13 and is closed by the magnetic fluid 17. Further, it is also possible to utilize a sound from the sound hole H1 as a reproduction sound of the loudspeaker.

In the above description, the edge pieces 14*a* to 14*d* are made of the same material as that of the diaphragm 13, but the present invention is not limited thereto. For example, the edge pieces 14*a* to 14*d* may be made of a material softer than the diaphragm 13. In this case, the stiffness of the edge pieces 14*a* to 14*d* can be further reduced, so that a reproduction limit of a low frequency range can be further expanded. In this case, furthermore, by making the diaphragm 13 from a material having high rigidity, a reproduction limit of a high frequency range can also be expanded, to further widen the reproduction range.

In the above description, there is no mention of the material thickness of the edge pieces 14*a* to 14*d*, but the material thickness may be the same as that of the diaphragm 13 or may be smaller than that of the diaphragm 13. When the material thickness of the edge pieces 14*a* to 14*d* is smaller than that of the diaphragm 13, the stiffness of the edge pieces 14*a* to 14*d* can be further reduced, so that a reproduction limit of a low frequency range can be further expanded.

In the above description, the edge pieces 14*a* to 14*d* are formed integrally with the diaphragm 13, but the edge pieces 14*a* to 14*d* and the diaphragm 13 may be formed as separate pieces. In this case, the edge pieces 14*a* to 14*d* are joined to the outer circumferential end of the diaphragm 13 by bonding or welding.

In the above description, a cross-sectional shape of each of the edge pieces 14*a* to 14*d* is a curved shape, but it may be any shape as long as it is a non-linear shape. For example, it may be a corrugated shape.

In the above description, four edge pieces 14*a* to 14*d* are used as the support, but two or three edge pieces may be used. The number of edge pieces is not limited to four.

Embodiment 2

Figure 2:
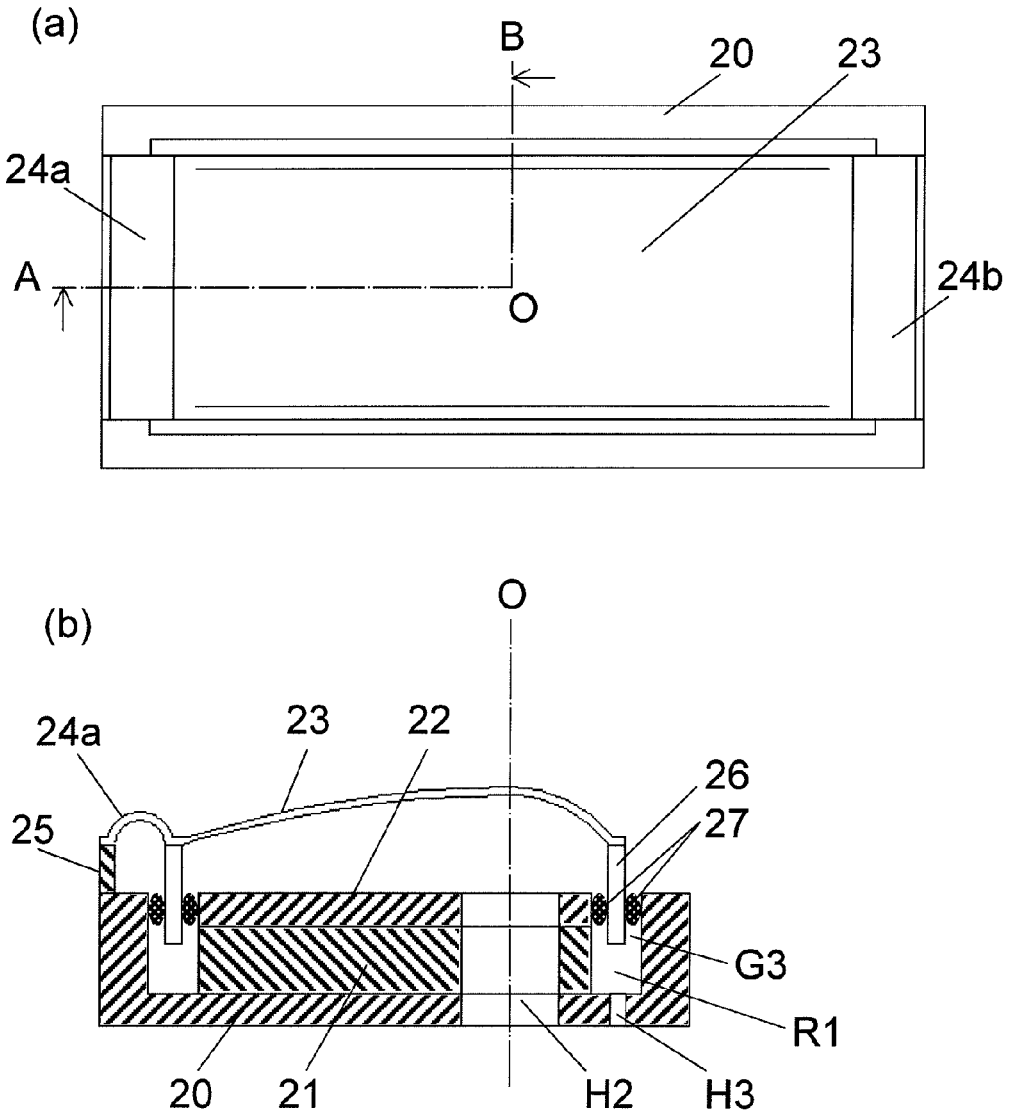
FIGS. 2(*a*) and 2(*b*) show a structural example of a loudspeaker according to Embodiment 2.

A structure of a loudspeaker according to Embodiment 2 of the present invention will be described with reference to FIGS. 2(*a*) and 2(*b*). FIGS. 2(*a*) and 2(*b*) show a structural example of the loudspeaker according to Embodiment 2. FIG. 2(*a*) is a front view of the loudspeaker, and FIG. 2(*b*) shows a structure section of the loudspeaker as cut along the line A-O-B and seen in the arrowed direction in FIG. 2(*a*).

Referring to FIGS. 2(*a*) and 2(*b*), the loudspeaker according to the present embodiment includes a yoke 20, a magnet 21, a plate 22, a diaphragm 23, edge pieces 24*a* and 24*b*, a spacer 25, a voice coil 26, and a magnetic fluid 27. As shown in FIG. 2(*a*), the outer shape of the loudspeaker according to the present embodiment is a rectangle when seen from a front side thereof. Accordingly, the outer shapes of the yoke 20, the magnet 21, the plate 22, the diaphragm 23, and the voice coil 26 on a front side thereof are also rectangles.

As shown in FIG. 2(*b*), the magnet 21 is fixed to an inner bottom surface of the yoke 20 which has a box-like shape with an upper surface thereof opened. The plate 22 is fixed to an upper surface of the magnet 21. A magnetic gap G3 is formed between the yoke 20 and the plate 22. Thus, the yoke 20, the magnet 21, and the plate 22 constitute a magnetic circuit having the magnetic gap G3. A sound hole H2 is formed in the yoke 20, the magnet 21, and the plate 22 so as to extend along a central axis O through the yoke 20, the magnet 21, and the plate 22.

As shown in FIG. 2(*b*), a cross-sectional shape of the diaphragm 23 is a curved-surface shape and convex upward (frontward). As a result of the cross-sectional shape of the diaphragm 23 being convex, the rigidity of the diaphragm 23 increases. The edge pieces 24*a* and 24*b* are provided at an outer circumferential portion of the diaphragm 23, as a support that vibratably supports the diaphragm 23. The edge pieces 24*a* and 24*b* are made of the same material as that of the diaphragm 23, and formed integrally with the diaphragm 23. As a result of the edge pieces 24*a* and 24*b* being formed integrally with the diaphragm 23, the number of components and assembling man-hours for the loudspeaker can be reduced. The edge pieces 24*a* and 24*b* are members corresponding to parts of a normal edge that is formed throughout the outer circumferential portion of the diaphragm 23. In an example shown in FIG. 2(*a*), a part of the edge having one end thereof joined to a left-side outer circumferential end (i.e., a left short side) of the diaphragm 23 is the edge piece 24*a*, and a part of the edge having one end thereof joined to a right-side outer circumferential end (i.e., a right short side) of the diaphragm 23 is the edge piece 24*b*. Similarly to the edge pieces 14*a* to 14*d*, a cross-sectional shape of each of the edge pieces 24*a* and 24*b* is a curved shape, that is, a non-linear shape. The other end of each of the edge pieces 24*a* and 24*b* is located on an upper surface of a side wall of the yoke 20 via the spacer 25.

The voice coil 26 is provided at the outer circumferential portion of the diaphragm 23 and positioned within the magnetic gap G3. In addition to the voice coil 26, the magnetic fluid 27 is also loaded in the magnetic gap G3. The magnetic fluid 27 holds the voice coil 26 within the magnetic gap G3 by means of its viscosity, to vibrate the voice coil 26 in a stable manner. In the present embodiment, the magnetic fluid 27 is loaded on each of inner and outer circumferences of the voice coil 26 within the magnetic gap G3.

A space R1 enclosed by the yoke 20, the magnet 21, the plate 22, the voice coil 26, and the magnetic fluid 27 is formed within the yoke 20. In the present embodiment, since the magnetic fluid 27 is loaded on each of the inner and outer circumferences of the voice coil 26, the space R1 is closed. Further, an air hole H3 is formed in the yoke 20 so as to pass air between the space R1 and the outside of the yoke 20.

Operations and effects of the loudspeaker configured as above will be described. Similarly to in Embodiment 1, when a music signal is applied to the voice coil 26, a sound is emitted from the diaphragm 13 and a sound from a rear surface of the diaphragm 23 is emitted through the sound hole H2. A great difference from Embodiment 1 is that the outer shape of the diaphragm 23 on the front side thereof is a rectangle, as described above. By forming the outer shape of the diaphragm 23 on the front side thereof into a rectangle and making the support from the edge pieces 24*a* and 24*b*, there is formed no corner on which stress particularly concentrates, and therefore the stiffness of the edge pieces 24*a* and 24*b* considerably decreases as compared with the normal edge that is formed throughout the outer circumferential portion of the diaphragm 23. As a result, the lowest resonance frequency of the loudspeaker can be considerably lowered. Thus, the structure of the loudspeaker according to the present embodiment provides a great advantage in downsizing and/or slimming the rectangle loudspeaker.

As described above, the structure of the loudspeaker according to the present embodiment is suitable for a rectangle loudspeaker capable of realizing both of downsizing and widening of a reproduction range and reducing non-linear distortion by the support as well as further improving a sound quality and efficiency.

In addition, according to the present embodiment, no edge is positioned at long sides of the diaphragm 23. Therefore, an effective vibration area of the diaphragm 23 can be easily expanded in a direction parallel to the short sides (an up and down direction in FIG. 2(*a*)), as compared with in Embodiment 1 and as compared with the normal edge that is formed throughout the outer circumferential portion of the diaphragm 23. As a result, a low frequency reproduction with large sound volume can be realized in spite of a slim shape.

Moreover, according to the present embodiment, the air hole H3 is formed in the yoke 20. Air trapped in the closed space R1 expands and contracts due to a temperature rise of the voice coil 26 and a pressure change of the operating environment of the loudspeaker. Due to the air thus expanding and contracting, stretching force is applied to the magnetic fluid 27, which may undesirably cause the magnetic fluid 27 to overflow from the magnetic gap G3. However, such a risk can be avoided because the air hole H3 suppresses variations in air pressure within the space R1.

In the above description, the edge pieces 24*a* and 24*b* are made of the same material as that of the diaphragm 23, but the present invention is not limited thereto. For example, the edge pieces 24*a* and 24*b* may be made of a material softer than the diaphragm 23. In this case, the stiffness of the edge pieces 24*a* and 24*b* can be more reduced, so that a reproduction limit of a low frequency range can be more expanded. In this case, furthermore, by making the diaphragm 23 from a material having high rigidity, a reproduction limit of a high frequency range can also be expanded, to further widen the reproduction range.

In the above description, there is no mention of the material thickness of the edge pieces 24*a* and 24*b*, but the material thickness may be the same as that of the diaphragm 23 or may be smaller than that of the diaphragm 23. When the material thickness of the edge pieces 24*a* and 24*b* is smaller than that of the diaphragm 23, the stiffness of the edge pieces 24*a* and 24*b* can be further reduced, so that a reproduction limit of a low frequency range can be further expanded.

In the above description, the edge pieces 24*a* and 24*b* are formed integrally with the diaphragm 23, but the edge pieces 24*a* and 24*b* and the diaphragm 23 may be formed as separate pieces. In this case, the edge pieces 24*a* and 24*b* are joined to the outer circumferential end of the diaphragm 23 by bonding or welding.

In the above description, a cross-sectional shape of each of the edge pieces 24*a* and 24*b* is a curved shape, but it may be any shape as long as it is a non-linear shape. For example, it may be a corrugated shape.

In the above description, one edge piece is provided at each of the short sides of the diaphragm 23, but the present invention is not limited thereto. It may be possible that two or three edge pieces are provided at each of the short sides of the diaphragm 23. This further reduces the stiffness of the support, so that the lowest resonance frequency of the loudspeaker is further lowered.

In the above description, each of the short sides of the diaphragm 23 is provided with the edge piece, but the present invention is not limited thereto. For example, each of long sides of the diaphragm 23 may be provided with the edge piece. In this case, an effective vibration area of the diaphragm 23 decreases as compared with the edge piece being provided at each short side. However, a length of the edge piece supporting the diaphragm 23 becomes longer. Therefore, the diaphragm 23 can more stably be supported. Alternatively, for example, it may be possible to provide edge pieces at each short side and at each long side of the diaphragm 23.

In the above description, the outer shape of the loudspeaker is a rectangle when seen from the front side thereof, but the present invention is not limited thereto. It suffices that the outer shape of the loudspeaker according to the present embodiment is a rectangular shape when seen from the front side thereof. It may be a square shape for example. In this case, the outer shapes of the yoke 20, the magnet 21, the plate 22, the diaphragm 23, and the voice coil 26 on the front side thereof correspond to the outer shape of the loudspeaker as seen from the front side thereof.

In the above description, the magnetic fluid 27 is loaded on each of the inner and outer circumferences of the voice coil 26, but the magnetic fluid 27 may be loaded only on the inner circumference side of the voice coil 26. In this case, it is not necessary to form the air hole H3 in the yoke 20, because the space R1 is not closed.

Embodiment 3

Figure 3:
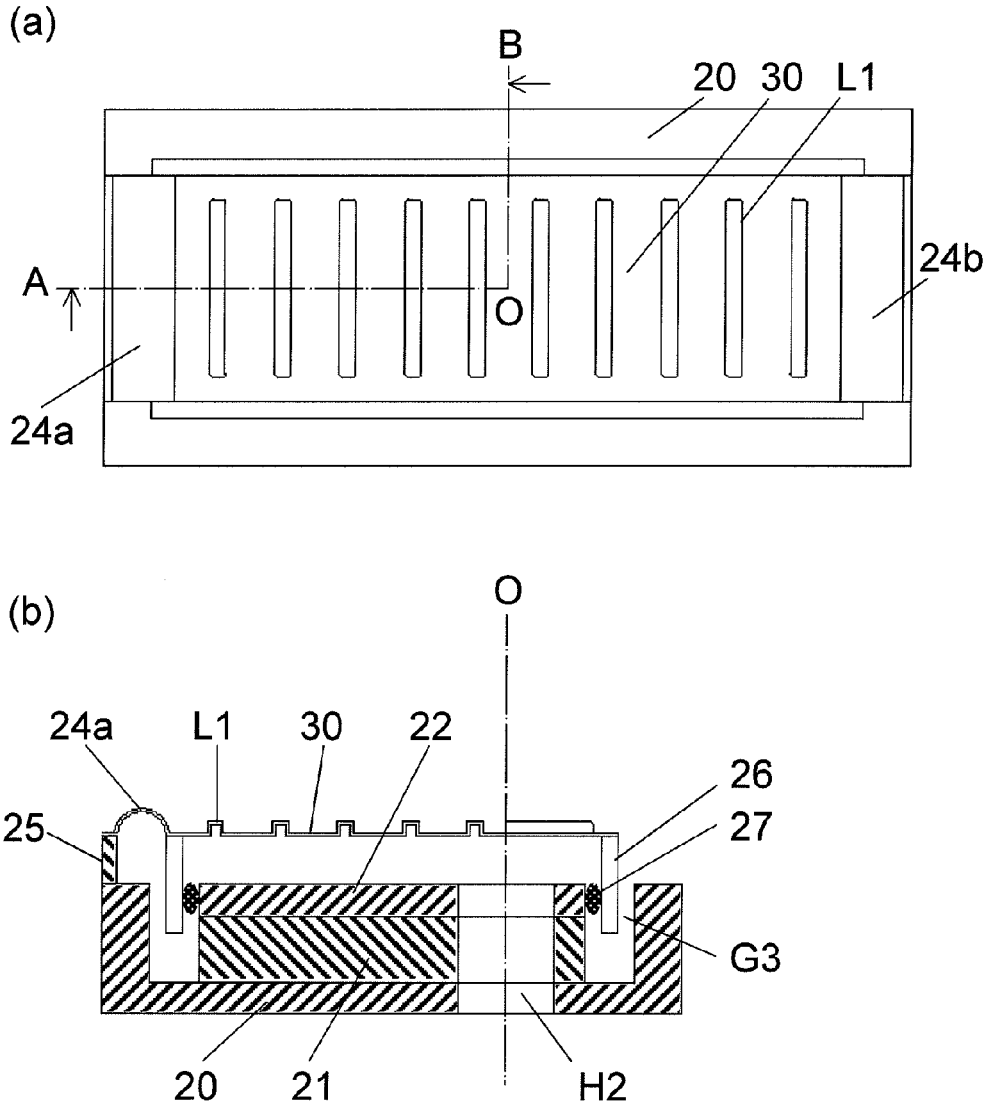
FIGS. 3(*a*) and 3(*b*) show a structural example of a loudspeaker according to Embodiment 3.

A structure of a loudspeaker according to Embodiment 3 of the present invention will be described with reference to FIGS. 3(*a*) and 3(*b*). FIGS. 3(*a*) and 3(*b*) show a structural example of the loudspeaker according to Embodiment 3. FIG. 3(*a*) is a front view of the loudspeaker, and (b) shows a structure section of the loudspeaker as cut along the line A-O-B and seen in the arrowed direction in FIG. 3(*a*).

Referring to FIGS. 3(*a*) and 3(*b*), the loudspeaker according to the present embodiment includes a yoke 20, a magnet 21, a plate 22, a diaphragm 30, edge pieces 24*a* and 24*b*, a spacer 25, a voice coil 26, and a magnetic fluid 27. The loudspeaker according to the present embodiment differs from that in Embodiment 2, in that the diaphragm 30 replaces the diaphragm 23. The other components are the same as in Embodiment 2, and therefore denoted by the same reference characters with descriptions thereof omitted. Hereinafter, different points will be mainly described.

The diaphragm 30 has a plate shape, and its cross-sectional shape is a linear shape as shown in FIG. 3(*b*). The diaphragm 30 is formed with a plurality of ribs L1 which are parallel to short sides of the diaphragm 30. The two edge pieces 24*a* and 24*b* are provided at the short sides of the diaphragm 30, as a support that vibratably supports the diaphragm 30. The edge pieces 24*a* and 24*b* are made of the same material as that of the diaphragm 30, and formed integrally with the diaphragm 30. In the present embodiment, the magnetic fluid 27 is loaded only on an inner circumference side of the voice coil 26 within the magnetic gap G3.

Operations and effects of the loudspeaker configured as above will be described. Similarly to in Embodiment 2, when a music signal is applied to the voice coil 26, a sound is emitted from the diaphragm 30 and a sound from a rear surface of the diaphragm 30 is emitted through the sound hole H2. A great difference from Embodiment 2 is that the diaphragm 30 has the plate shape and that the plurality of ribs L1 are formed on the diaphragm 30, as described above. By adopting the plate-shaped diaphragm 30, the total thickness of the loudspeaker (a length of the loudspeaker in an up and down direction in FIG. 3(*b*)) can be reduced. This is of great advantage in downsizing the loudspeaker. In addition, by forming the plurality of ribs L1 on the diaphragm 30, the rigidity of the diaphragm 30 can be increased so that a reproduction limit of a high frequency range can be more expanded.

As described above, according to the present embodiment, the total thickness of the loudspeaker can be reduced and a reproduction limit of a high frequency range can be more expanded, as compared with in Embodiment 2.

In the above description, the edge pieces 24*a* and 24*b* are made of the same material as that of the diaphragm 30, but the present invention is not limited thereto. For example, the edge pieces 24*a* and 24*b* may be made of a material softer than the diaphragm 30. In this case, furthermore, the diaphragm 30 may be made of a material having high rigidity. In the above description, in addition, there is no mention of the material thickness of the edge pieces 24*a* and 24*b*, but the material thickness may be the same as that of the diaphragm 30 or may be smaller than that of the diaphragm 30. In the above description, moreover, the edge pieces 24*a* and 24*b* are formed integrally with the diaphragm 30, but the edge pieces 24*a* and 24*b* and the diaphragm 30 may be formed as separate pieces. In this case, the edge pieces 24*a* and 24*b* are joined to an outer circumferential end of the diaphragm 30 by bonding or welding.

In the above description, the rigidity of the diaphragm 30 is increased by forming the plurality of ribs L1 on the diaphragm 30, but the present invention is not limited thereto. For example, the rigidity may be increased by forming one rib L1 on the diaphragm 30. Alternatively, the rigidity may be increased for example by adopting, as an internal structure of the diaphragm 30, a sandwich structure in which a honeycomb-shaped core is sandwiched by plate-shaped surface materials.

Embodiment 4

Figure 4:
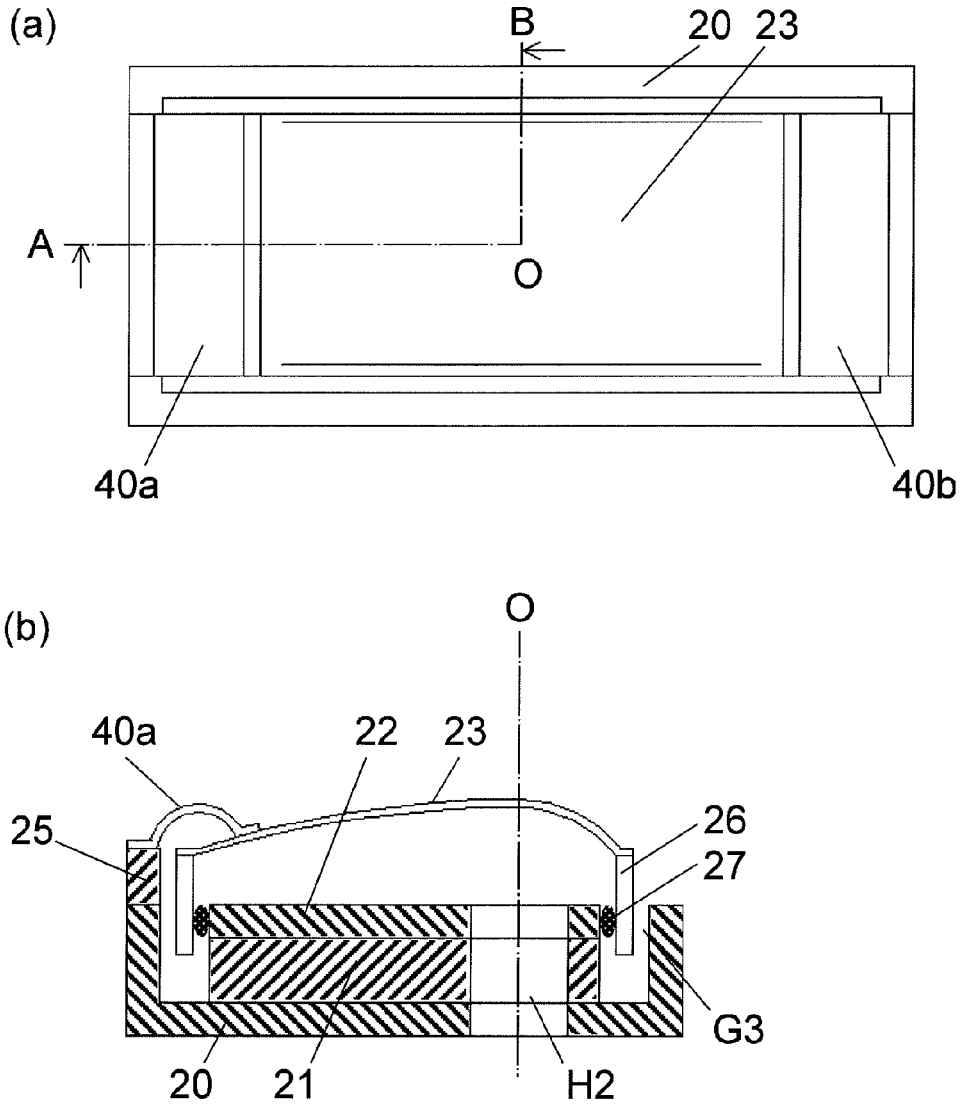
FIGS. 4(*a*) and 4(*b*) show a structural example of a loudspeaker according to Embodiment 4.

A structure of a loudspeaker according to Embodiment 4 of the present invention will be described with reference to FIGS. 4(*a*) and 4(*b*). FIGS. 4(*a*) and 4(*b*) show a structural example of the loudspeaker according to Embodiment 4. FIG. 4(*a*) is a front view of the loudspeaker, and FIG. 4(*b*) shows a structure section of the loudspeaker as cut along the line A-O-B and seen in the arrowed direction in FIG. 4(*a*).

Referring to FIGS. 4(*a*) and 4(*b*), the loudspeaker according to the present embodiment includes a yoke 20, a magnet 21, a plate 22, a diaphragm 23, edge pieces 40*a* and 40*b*, a spacer 25, a voice coil 26, and a magnetic fluid 27. The loudspeaker according to the present embodiment differs from that in Embodiment 2, in that the edge pieces 40*a* and 40*b* replace the edge pieces 24*a* and 24*b*. The other components are the same as in Embodiment 2, and therefore denoted by the same reference characters with descriptions thereof omitted. Hereinafter, different points will be mainly described.

The edge pieces 40*a* and 40*b* are a support that vibratably supports the diaphragm 23, and provided at an outer circumferential portion of the diaphragm 23. The edge pieces 40*a* and 40*b* are made of the same material as that of the diaphragm 23. The edge pieces 40*a* and 40*b*, and the diaphragm 23 are formed as separate pieces. The edge pieces 40*a* and 40*b* are members corresponding to parts of a normal edge that is formed throughout the outer circumferential portion of the diaphragm 23. In an example shown in FIG. 4(*a*), a part of the edge having one end thereof joined to a portion of the diaphragm 23 inside and near a left-side outer circumferential end thereof (i.e., inside and near a left short side thereof) is the edge piece 40*a*, and a part of the edge having one end thereof joined to a portion of the diaphragm 23 inside and near a right-side outer circumferential end thereof (i.e., inside and near a right short side thereof) is the edge piece 40*b*. Thus, one end of each of the edge pieces 40*a* and 40*b* are not provided at the outer circumferential end of the diaphragm 23 but provided inside the outer circumferential end of the diaphragm 23, that is, on a curved surface of the diaphragm 23. Similarly to the edge pieces 24*a* and 24*b*, a cross-sectional shape of each of the edge pieces 40*a* and 40*b* is a curved shape, that is, a non-linear shape. The other end of each of the edge pieces 40*a* and 40*b* is located on an upper surface of a side wall of the yoke 20 via the spacer 25. In the present embodiment, the magnetic fluid 27 is loaded only on an inner circumference side of the voice coil 26 within the magnetic gap G3.

Operations and effects of the loudspeaker configured as above will be described. Similarly to in Embodiment 2, when a music signal is applied to the voice coil 26, a sound is emitted from the diaphragm 23 and a sound from a rear surface of the diaphragm 23 is emitted through a sound hole H2. A great difference from Embodiment 2 is that one end of each of the edge pieces 40*a* and 40*b* is located on the curved surface of the diaphragm 23, as described above. By locating the one end of the edge piece on the curved surface of the diaphragm 23, an extent of protruding of the edge piece beyond the outer circumferential end of the diaphragm 23 is reduced as compared with in Embodiment 2 where the one end of the edge piece is located at the outer circumferential end of the diaphragm 23. As a result, even though an outside dimension of the loudspeaker is the same as in Embodiment 2, an effective vibration area of the diaphragm 23 can be made larger and efficiency can be improved as compared with in Embodiment 2.

As described above, according to the present embodiment, efficiency can be improved as compared with in Embodiment 2.

In the above description, the edge pieces 40*a* and 40*b* are made of the same material as that of the diaphragm 23, but the present invention is not limited thereto. For example, the edge pieces 40*a* and 40*b* may be made of a material softer than the diaphragm 23. In this case, furthermore, the diaphragm 23 may be made of a material having high rigidity. In the above description, there is no mention of the material thickness of the edge pieces 40*a* and 40*b*, but the material thickness may be the same as that of the diaphragm 23 or may be smaller than that of the diaphragm 23.

In the above description, a cross-sectional shape of each of the edge pieces 24*a* and 24*b* is a curved shape, but it may be any shape as long as it is a non-linear shape. For example, it may be a corrugated shape.

In the above description, one edge piece is provided at a portion of the diaphragm 23 inside each short side thereof, but the present invention is not limited thereto. It may be possible that two or three edge pieces are provided at a portion of the diaphragm 23 inside each short side thereof. This further reduces the stiffness of the support, so that the lowest resonance frequency of the loudspeaker is more lowered.

Embodiment 5

Figure 5:
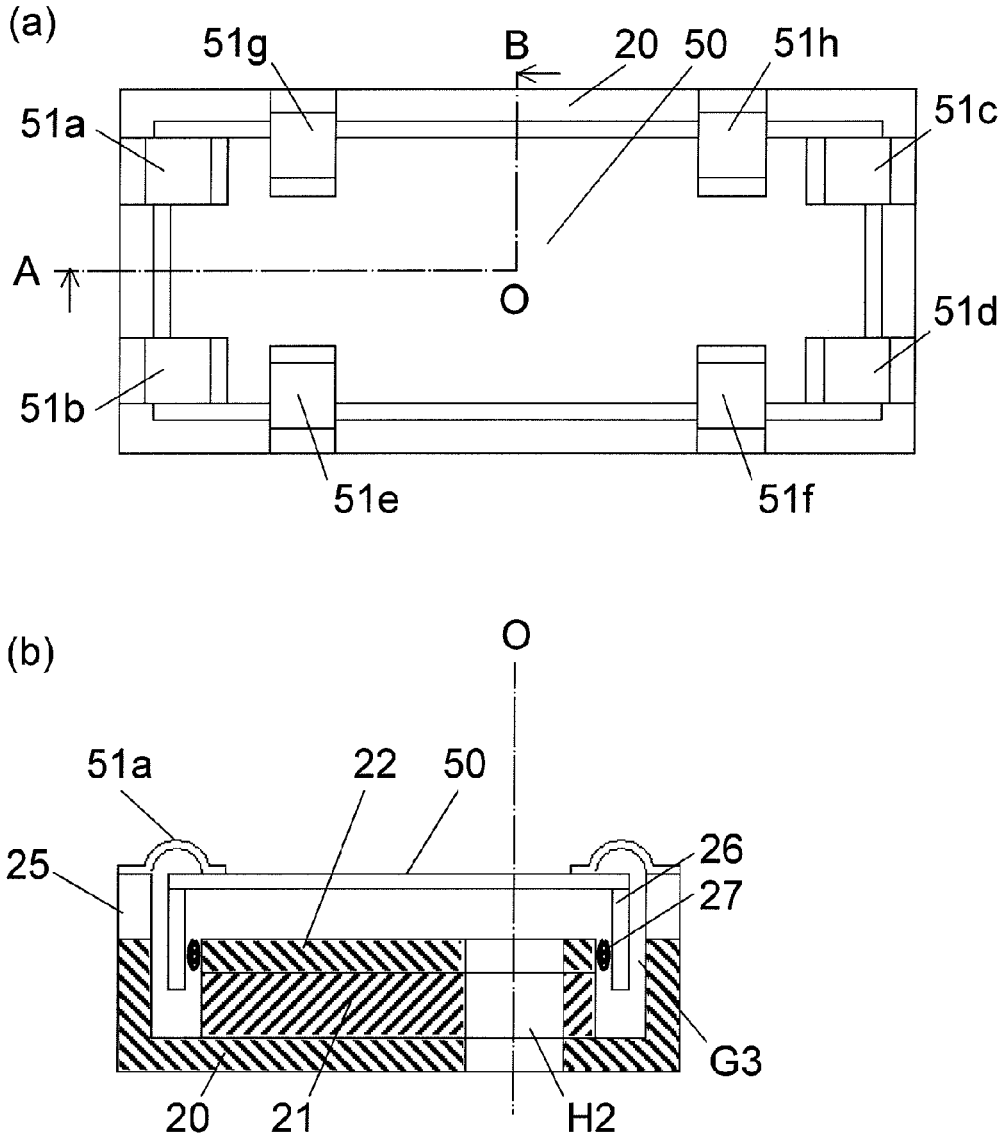
FIGS. 5(*a*) and 5(*b*) show a structural example of a loudspeaker according to Embodiment 5.

A structure of a loudspeaker according to Embodiment 5 of the present invention will be described with reference to FIGS. 5(*a*) and 5(*b*). FIGS. 5(*a*) and 5(*b*) show a structural example of the loudspeaker according to Embodiment 5. FIG. 5(*a*) is a front view of the loudspeaker, and FIG. 5(*b*) shows a structure section of the loudspeaker as cut along the line A-O-B and seen in the arrowed direction in FIG. 5(*a*).

Referring to FIGS. 5(*a*) and 5(*b*), the loudspeaker according to the present embodiment includes a yoke 20, a magnet 21, a plate 22, a diaphragm 50, edge pieces 51*a* to 51*h*, a spacer 25, a voice coil 26, and a magnetic fluid 27. The loudspeaker according to the present embodiment differs from that in Embodiment 4, in that the diaphragm 50 replaces the diaphragm 23 and that the edge pieces 51*a* to 51*h* replace the edge pieces 40*a* and 40*b*. The other components are the same as in Embodiment 4, and therefore denoted by the same reference characters with descriptions thereof omitted. Hereinafter, different points will be mainly described.

The diaphragm 50 has a plate shape, and its cross-sectional shape is a linear shape as shown in FIG. 5(*b*). The edge pieces 51*a* to 51*h* are provided at an outer circumferential portion of the diaphragm 50, as a support that vibratably supports the diaphragm 50. The edge pieces 51*a* to 51*h* are made of the same material as that of the diaphragm 50. The edge pieces 51*a* to 51*h* and the diaphragm 50 are formed as separate pieces. The edge pieces 51*a* to 51*h* are members corresponding to parts of a normal edge that is formed throughout the outer circumferential portion of the diaphragm 50. In an example shown in FIG. 5(*a*), a part of the edge having one end thereof joined to an upper portion of the diaphragm 50 inside and near a left-side outer circumferential end of the diaphragm 50 (i.e., an upper portion inside and near a left short side) is an edge piece 51*a*; a part of the edge having one end thereof joined to a lower portion of the diaphragm 50 inside and near the left-side outer circumferential end of the diaphragm 50 (i.e., a lower portion inside and near the left short side) is an edge piece 51*b*; a part of the edge having one end thereof joined to an upper portion of the diaphragm 50 inside and near a right-side outer circumferential end of the diaphragm 50 (i.e., an upper portion inside and near a right short side) is an edge piece 51*c*; a part of the edge having one end thereof joined to a lower portion of the diaphragm 50 inside and near the right-side outer circumferential end of the diaphragm 50 (i.e., a lower portion inside and near the right short side) is an edge piece 51*d*; a part of the edge having one end thereof joined to a left portion of the diaphragm 50 inside and near a lower outer circumferential end of the diaphragm 50 (i.e., a left portion inside and near a lower long side) is an edge piece 51*e*; a part of the edge having one end thereof joined to a right portion of the diaphragm 50 inside and near the lower outer circumferential end of the diaphragm 50 (i.e., a right portion inside and near the lower long side) is an edge piece 51*f*; a part of the edge having one end thereof joined to a left portion of the diaphragm 50 inside and near an upper outer circumferential end of the diaphragm 50 (i.e., a left portion inside and near an upper long side) is an edge piece 51*g*; and a part of the edge having one end thereof joined to a right portion of the diaphragm 50 inside and near the upper outer circumferential end of the diaphragm 50 (i.e., a right portion inside and near the upper long side) is an edge piece 51*h*. Thus, one end of each of the edge pieces 51*a* to 51*h* is not provided at the outer circumferential end of the diaphragm 50 but provided inside the outer circumferential end of the diaphragm 50, that is, on a plane of the diaphragm 50. Similarly to the edge pieces 40*a* and 40*b*, a cross-sectional shape of each of the edge pieces 51*a* to 51*h* is a curved shape, that is, a non-linear shape. The other end of each of the edge pieces 51*a* to 51*h* is located on an upper surface of a side wall of the yoke 20 via the spacer 25.

Operations and effects of the loudspeaker configured as above will be described. Similarly to in Embodiment 4, when a music signal is applied to the voice coil 26, a sound is emitted from the diaphragm 50 and a sound from a rear surface of the diaphragm 50 is emitted through a sound hole H2. A great difference from Embodiment 4 is that the diaphragm 50 has a plate shape and that the edge pieces 51*a* to 51*h* are provided not only on the short sides but also on the long sides of the diaphragm 50, as described above.

By adopting the diaphragm 50 of plate shape, the total thickness of the loudspeaker (a length of the loudspeaker in an up and down direction in FIG. 5(*b*)) can be reduced. This provides a great advantage in downsizing the loudspeaker. In addition, by providing the edge pieces on the long sides of the diaphragm 50 as well, the diaphragm 50 can be supported more stably than in Embodiment 4. Moreover, by providing two edge pieces at a portion of the diaphragm 50 inside each short side thereof and at a portion of the diaphragm 50 inside each long side thereof, the stiffness of the edge pieces can be reduced even though the edge pieces are provided on the long sides of the diaphragm 50.

As described above, according to the present embodiment, the total thickness of the loudspeaker can be reduced to support the diaphragm in a more stabilized manner than in Embodiment 4.

In the above description, the edge pieces 51*a* to 51*h* are made of the same material as that of the diaphragm 50, but the present invention is not limited thereto. For example, the edge pieces 51*a* to 51*h* may be made of a material softer than the diaphragm 50. In this case, furthermore, the diaphragm 50 may be made of a material having high rigidity. In addition, a rib may be formed on the diaphragm 50 in order to increase the rigidity of the diaphragm 50. In the above description, there is no mention of the material thickness of the edge pieces 51*a* to 51*h*, but the material thickness may be the same as that of the diaphragm 50 or may be smaller than that of the diaphragm 50.

In the above description, a cross-sectional shape of each of the edge pieces 51*a* to 51*h* is a curved shape, but it may be any shape as long as it is a non-linear shape. For example, it may be a corrugated shape.

In the above description, two edge pieces are provided at a portion of the diaphragm 50 inside each short side thereof and at a portion of the diaphragm 50 inside each long side thereof, but the present invention is not limited thereto. For example, it may be possible that three edge pieces are provided at a portion of the diaphragm 50 inside each short side thereof and at a portion of the diaphragm 50 inside each long side thereof.

Embodiment 6

Figure 6:
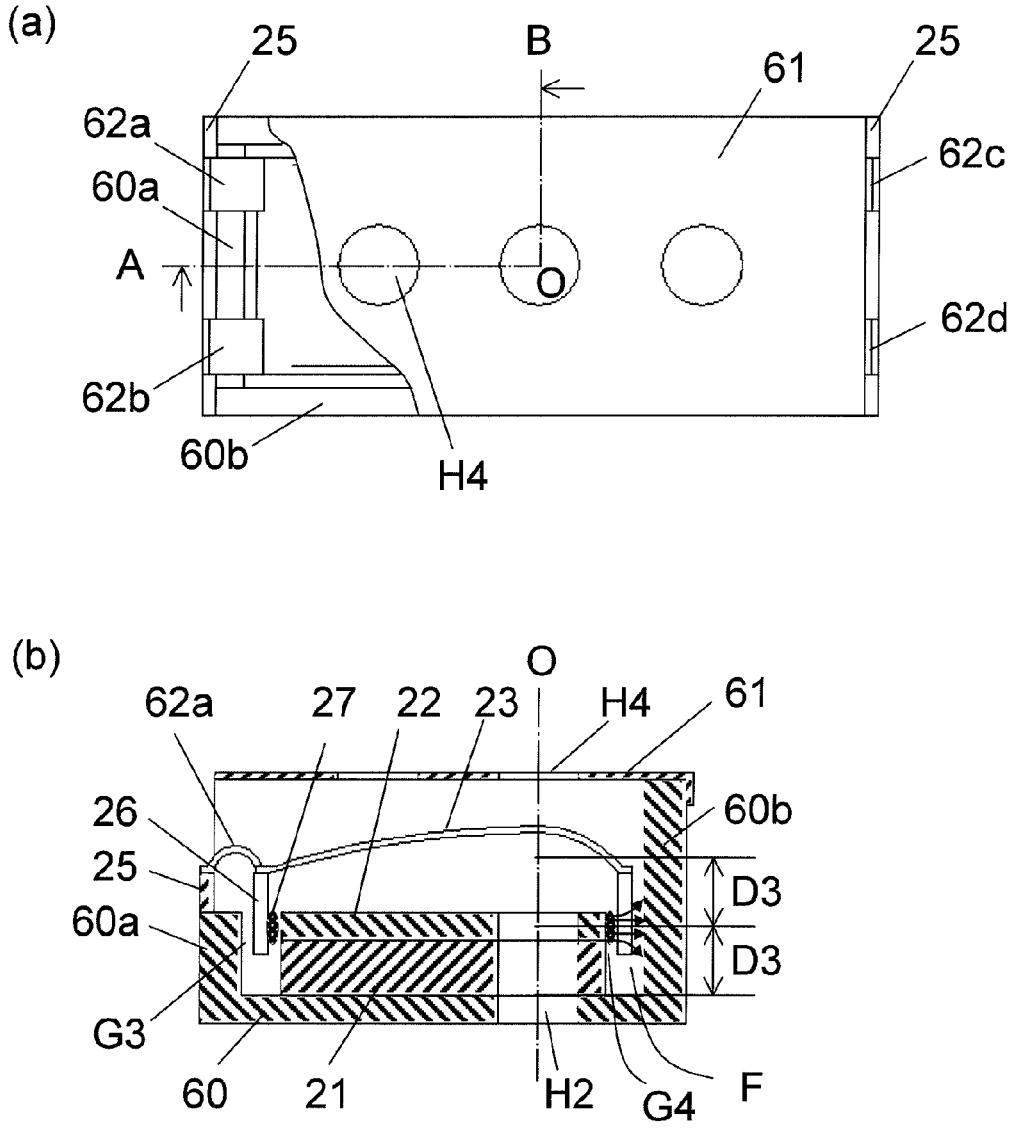
FIGS. 6(*a*) and 6(*b*) show a structural example of a loudspeaker according to Embodiment 6.

A structure of a loudspeaker according to Embodiment 6 of the present invention will be described with reference to FIGS. 6(*a*) and 6(*b*). FIGS. 6(*a*) and 6(*b*) show a structural example of the loudspeaker according to Embodiment 6. FIG. 6(*a*) is a front view of the loudspeaker, and FIG. 6(*b*) shows a structure section of the loudspeaker as cut along the line A-O-B and seen in the arrowed direction in FIG. 6(*a*).

Referring to FIGS. 6(*a*) and 6(*b*), the loudspeaker according to the present embodiment includes a yoke 60, a magnet 21, a plate 22, a protector 61, a diaphragm 23, edge pieces 62*a* to 62*d*, a spacer 25, a voice coil 26, and a magnetic fluid 27. The loudspeaker according to the present embodiment differs from that in Embodiment 2, in that the yoke 60 replaces the yoke 20, that the protector 61 is added, and that the edge pieces 62*a* to 62*d* replace the edge pieces 24*a* and 24*b*. The other components are the same as in Embodiment 2, and therefore denoted by the same reference characters with descriptions thereof omitted. Hereinafter, different points will be mainly described.

As shown in FIG. 6(*b*), the magnet 21 is fixed to an inner bottom surface of the yoke 60 which has a box-like shape with an upper surface thereof opened. The plate 22 is fixed to an upper surface of the magnet 21. A magnetic gap G3 is formed between a short-side side wall 60*a* of the yoke 60 and the plate 22. A magnetic gap G4 is formed between a long-side side wall 60*b* of the yoke 60 and the plate 22. Thus, the yoke 60, the magnet 21, and the plate 22 constitute a magnetic circuit having the magnetic gaps G3 and G4. A sound hole H2 is formed in the yoke 60, the magnet 21, and the plate 22 so as to extend along a central axis O through the yoke 60, the magnet 21, and the plate 22. An upper surface of the long-side side wall 60*b* is at a level higher than an upper surface of the short-side side wall 60*a*. Preferably, when a distance from the center of the plate 22 to the inner bottom surface of the yoke 60 is defined as D3, the long-side side wall 60*b* is higher than the inner bottom surface of the yoke 60 by at least two times the distance D3, as shown in FIG. 6(*b*). In the present embodiment, the upper surface of the long-side side wall 60*b* is at a level higher than a top point of the diaphragm 23 to which the diaphragm 23 comes upon its largest amplitude. The protector 61 has a plurality of sound holes H4, and is provided on the upper surface of the long-side side wall 60*b* of the yoke 60.

The edge pieces 62*a* to 62*d* are provided at an outer circumferential portion of the diaphragm 23, as a support that vibratably supports the diaphragm 23. The edge pieces 62*a* to 62*d* are made of the same material as that of the diaphragm 23, and formed integrally with the diaphragm 23. As a result of the edge pieces 62*a* to 62*d* being formed integrally with the diaphragm 23, the number of components and assembling man-hours for the loudspeaker can be reduced. The edge pieces 62*a* to 62*d* are members corresponding to parts of a normal edge that is formed throughout the outer circumferential portion of the diaphragm 23. In an example shown in FIG. 6(*a*), a part of the edge having one end thereof joined to an upper portion of a left-side outer circumferential end (i.e., an upper portion of a left short side) of the diaphragm 23 is the edge piece 62*a*; a part of the edge having one end thereof joined to a lower portion of the left-side outer circumferential end (i.e., a lower portion of the left short side) of the diaphragm 23 is the edge piece 62*b*; a part of the edge having one end thereof joined to an upper portion of a right-side outer circumferential end (i.e., an upper portion of a right short side) of the diaphragm 23 is the edge piece 62*c*; and a part of the edge having one end thereof joined to a lower portion of the right-side outer circumferential end (i.e., a lower portion of the right short side) of the diaphragm 23 is the edge piece 62*d*. Similarly to the edge pieces 24*a* and 24*b*, a cross-sectional shape of each of the edge pieces 62*a* to 62*d* is a curved shape, that is, a non-linear shape. The other end of each of the edge pieces 62*a* to 62*d* is located on the upper surface of the short-side side wall 60*a* of the yoke 60 via the spacer 25.

The voice coil 26 is provided at the outer circumferential portion of the diaphragm 23 and positioned within the magnetic gaps G3 and G4. In addition to the voice coil 26, the magnetic fluid 27 is also loaded in the magnetic gaps G3 and G4. In the present embodiment, the magnetic fluid 27 is loaded only on an inner circumference side of the voice coil 26 within the magnetic gaps G3 and G4.

Operations and effects of the loudspeaker configured as above will be described. Similarly to in Embodiment 2, when a music signal is applied to the voice coil 26, a sound is emitted from the diaphragm 23 and a sound from a rear surface of the diaphragm 23 is emitted through the sound hole H2. A great difference from Embodiment 2 is that the long-side side wall 60*b* of the yoke 60 is higher than the short-side side wall 60*a* of the yoke 60, that the protector 61 is added, and that two edge pieces are provided at each short side of the diaphragm 23.

By making the long-side side wall 60*b* of the yoke 60 higher than the short-side side wall 60*a* of the yoke 60, magnetic flux within the magnetic gap G4 passing through the voice coil 26 flows substantially symmetrically about the plate 22 in a direction of vibration of the voice coil 26, as indicated by the reference character F in FIG. 6(*b*). This improves linearity of driving force occurring in the voice coil 26, so that driving force distortion in the case of large amplitude can be reduced.

Moreover, providing the protector 61 can prevent the diaphragm 23 from being externally damaged by accident.

Further, by providing two edge pieces at each short side of the diaphragm 23, the stiffness of the edge pieces can be further reduced as compared with in Embodiment 2, so that the lowest resonance frequency of the loudspeaker is further lowered.

As described above, according to the present embodiment, as compared with in Embodiment 2, a higher sound quality and a wider range can be realized, and damage to the diaphragm 23 can be prevented.

In the above description, the edge pieces 62*a* to 62*d* are made of the same material as that of the diaphragm 23, but the present invention is not limited thereto. For example, the edge pieces 62*a* to 62*d* may be made of a material softer than the diaphragm 23. In this case, furthermore, the diaphragm 23 may be made of a material having high rigidity. In the above description, there is no mention of the material thickness of the edge pieces 62*a* to 62*d*, but the material thickness may be the same as that of the diaphragm 23 or may be smaller than that of the diaphragm 23.

In the above description, a cross-sectional shape of each of the edge pieces 62*a* to 62*d* is a curved shape, but it may be any shape as long as it is a non-linear shape. For example, it may be a corrugated shape.

In the above description, two edge pieces are provided at each short side of the diaphragm 23, but the present invention is not limited thereto. For example, it may be possible that three edge pieces are provided at each short side of the diaphragm 23.

Embodiment 7

Figure 7:
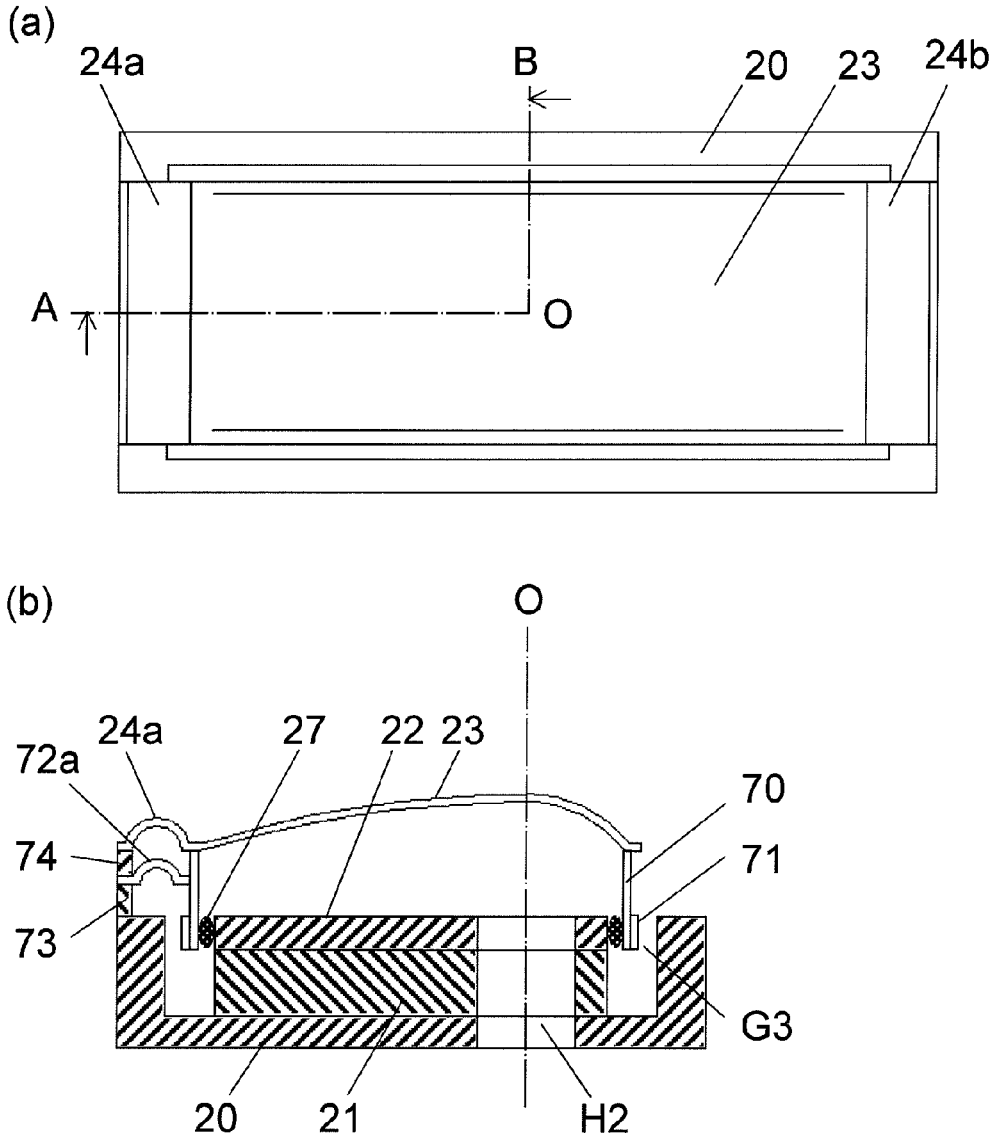
FIGS. 7(*a*) and 7(*b*) show a structural example of a loudspeaker according to Embodiment 7.

A structure of a loudspeaker according to Embodiment 7 of the present invention will be described with reference to FIGS. 7(*a*) and 7(*b*). FIGS. 7(*a*) and 7(*b*) show a structural example of the loudspeaker according to Embodiment 7. FIG. 7(*a*) is a front view of the loudspeaker, and FIG. 7(*b*) shows a structure section of the loudspeaker as cut along the line A-O-B and seen in the arrowed direction in FIG. 7(*a*).

Referring to FIGS. 7(*a*) and 7(*b*), the loudspeaker according to the present embodiment includes a yoke 20, a magnet 21, a plate 22, a diaphragm 23, edge pieces 24*a* and 24*b*, a voice coil bobbin 70, a voice coil 71, edge pieces 72*a* and 72*b* (not shown), spacers 73 and 74, and a magnetic fluid 27. The loudspeaker according to the present embodiment differs from that in Embodiment 2, in that the voice coil bobbin 70 is added, that the voice coil 71 replaces the voice coil 26, that the edge pieces 72*a* and 72*b* are added, and that the spacers 73 and 74 replace the spacer 25. The other components are the same as in Embodiment 2, and therefore denoted by the same reference characters with descriptions thereof omitted. Hereinafter, different points will be mainly described.

The voice coil bobbin 70 is provided at an outer circumferential portion of the diaphragm 23. The voice coil 71 is provided on an outer circumference of the voice coil bobbin 70 and positioned within the magnetic gap G3. The edge pieces 72*a* and 72*b* are provided at an outer circumferential portion of the voice coil bobbin 70, as a support that vibratably supports the voice coil bobbin 70. Specifically, the edge piece 72*a* is provided on the outer circumference of the voice coil bobbin 70 so as to be immediately under the edge piece 24*a*, and the edge piece 72*b* is provided on the outer circumference of the voice coil bobbin 70 so as to be immediately under the edge piece 24*b*. Similarly to the edge pieces 24*a* and 24*b*, a cross-sectional shape of each of the edge pieces 72*a* and 72*b* is a curved shape, that is, a non-linear shape. The other end of each of the edge pieces 72*a* and 72*b* is located on an upper surface of a short-side side wall of the yoke 20 via the spacer 73. The other end of each of the edge pieces 24*a* and 24*b* is located on an upper surface of the other end of each of the edge pieces 72*a* and 72*b* via the spacer 74.

Operations and effects of the loudspeaker configured as above will be described. Similarly to in Embodiment 2, when a music signal is applied to the voice coil 26, a sound is emitted from the diaphragm 23 and a sound from a rear surface of the diaphragm 23 is emitted through a sound hole H2. A great difference from Embodiment 2 is that the edge pieces 72*a* and 72*b* are added. By adding the edge pieces 72*a* and 72*b* as the support, the voice coil 71 can more stably be held within the magnetic gap G3 even when the diaphragm 23 shows large amplitude. In combination with the cooling effect and the holding power due to the viscosity of the magnetic fluid 27, the loudspeaker with high input-resistance and high power output can be realized.

As described above, according to the present embodiment, the diaphragm and the voice coil can be supported in a more stabilized manner than in Embodiment 2.

In the above description, one edge piece is provided at each short side of the voice coil bobbin 70, but the present invention is not limited thereto. It may be possible that two or three edge pieces are provided at each short side of the voice coil bobbin 70. This further reduces the stiffness of the support, so that the lowest resonance frequency of the loudspeaker is further lowered.

In the above description, the edge piece is provided at each short side of the voice coil bobbin 70, but the present invention is not limited thereto. For example, in a case where the edge piece is provided at each long side of the diaphragm 23, the edge piece may accordingly be provided at each long side of the voice coil bobbin 70. For example, in addition, in a case where the edge piece is provided at each long side and at each short side of the diaphragm 23, the edge piece may accordingly be provided at each short side and at each long side of the voice coil bobbin 70.

In the above description, a cross-sectional shape of each of the edge pieces 72*a* and 72*b* is a curved shape, but it may be any shape as long as it is a non-linear shape. For example, it may be a corrugated shape.

Embodiment 8

Figure 8:
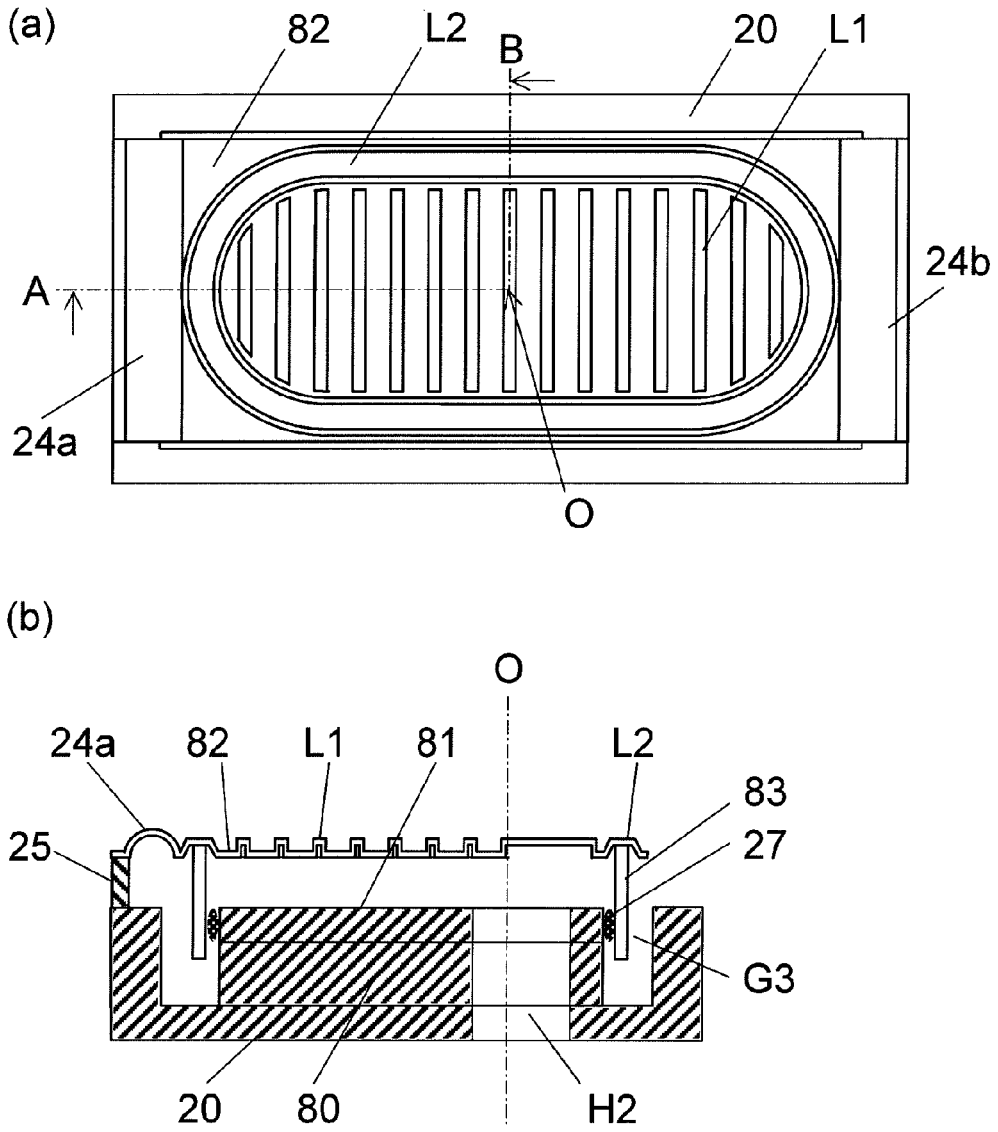
FIGS. 8(*a*) and 8(*b*) show a structural example of a loudspeaker according to Embodiment 8.

A structure of a loudspeaker according to Embodiment 8 of the present invention will be described with reference to FIGS. 8(*a*) and 8(*b*). FIGS. 8(*a*) and 8(*b*) show a structural example of the loudspeaker according to Embodiment 8. FIG. 8(*a*) is a front view of the loudspeaker, and FIG. 8(*b*) shows a structure section of the loudspeaker as cut along the line A-O-B and seen in the arrowed direction in FIG. 8(*a*).

Referring to FIGS. 8(*a*) and 8(*b*), the loudspeaker according to the present embodiment includes a yoke 20, a magnet 80, a plate 81, a diaphragm 82, edge pieces 24*a* and 24*b*, a spacer 25, a voice coil 83, and a magnetic fluid 27. The loudspeaker according to the present embodiment differs from that in Embodiment 2, in that the magnet 80, the plate 81, and the voice coil 83 whose outer shapes on a front side thereof are track shapes replace the magnet 21, the plate 22, and the voice coil 26 whose outer shapes on the front side thereof are rectangles, and that the diaphragm 82 replaces the diaphragm 23. The other components are the same as in Embodiment 2 and therefore denoted by the same reference characters with descriptions thereof omitted. Hereinafter, different points will be mainly described.

The magnet 80 is fixed to an inner bottom surface of the yoke 20 whose outer shape on the front side thereof is the track shape and which has a box-like shape with an upper surface thereof opened. The plate 81, whose outer shape on the front side thereof is the track shape, is fixed to an upper surface of the magnet 80. A magnetic gap G3 is formed between the yoke 20 and the plate 81. Thus, the yoke 20, the magnet 80, and the plate 81 constitute a magnetic circuit having the magnetic gap G3. A sound hole H2 is formed in the yoke 20, the magnet 80, and the plate 81 so as to extend along a central axis O through the yoke 20, the magnet 80, and the plate 81.

The diaphragm 82 has a plate shape, and its cross-sectional shape is a linear shape as shown in FIG. 8(*b*). The diaphragm 82 is formed with a plurality of ribs L1 which are parallel to short sides of the diaphragm 82. The diaphragm 82 is also formed with a rib L2 whose outer shape on a front side thereof is a track shape enclosing the plurality of ribs L1. The two edge pieces 24*a* and 24*b* are provided at the short sides of the diaphragm 82, as a support that vibratably supports the diaphragm 82. The edge pieces 24*a* and 24*b* are made of the same material as that of the diaphragm 82, and formed integrally with the diaphragm 82.

The voice coil 83, whose outer shape and inner shape on the front side thereof are track shapes, is provided on the rib L2 of the diaphragm 82 and positioned within the magnetic gap G3. In addition to the voice coil 83, the magnetic fluid 27 is also loaded in the magnetic gap G3. In the present embodiment, the magnetic fluid 27 is loaded only on an inner circumference side of the voice coil 83 within the magnetic gap G3.

Operations and effects of the loudspeaker configured as above will be described. Similarly to in Embodiment 2, when a music signal is applied to the voice coil 83, a sound is emitted from the diaphragm 82 and a sound from a rear surface of the diaphragm 82 is emitted through the sound hole H2. A great difference from Embodiment 2 is that the diaphragm 82 has the plate shape and that the inner shape of the voice coil 83 on the front side thereof is the track shape.

By adopting the diaphragm 82 of plate shape, the total thickness of the loudspeaker (a length of the loudspeaker in an up and down direction in FIG. 8(*b*)) can be reduced. This provides a great advantage in downsizing the loudspeaker. In addition, by forming the plurality of ribs L1 on the diaphragm 82, the rigidity of the diaphragm 82 can be increased and a reproduction limit of a high frequency range can be further expanded.

Figure 9:
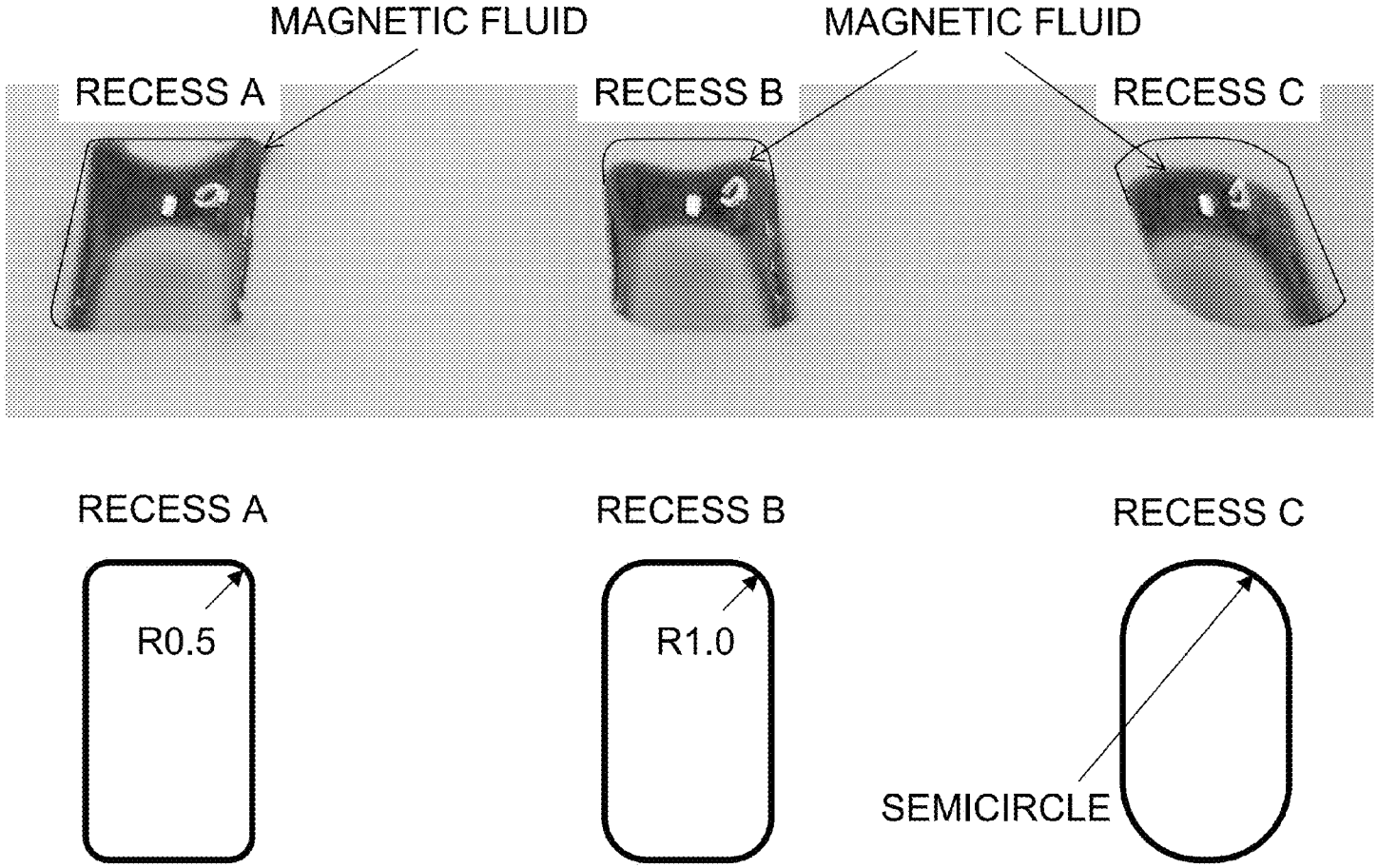
FIG. 9 shows an observation result of a magnetic fluid injected respectively into recesses A to C having different configurations.

Further, the front inner shape of the voice coil 83 is the track shape. In the following, effects obtained by this structure will be specifically described. FIG. 9 shows an observation result of a magnetic fluid injected respectively into recesses A to C having different configurations. The recesses A to C are formed in a block of ABS resin. The outer shape of the recess A is equivalent to the shape of the voice coil 83 whose front inner shape is a rectangle with corners rounded at a radius R=0.5 [mm]. The outer shape of the recess B is equivalent to the shape of the voice coil 83 with corners rounded at a radius R=1.0 [mm]. The outer shape of the recess C is equivalent to the shape of the voice coil 83 whose front inner shape is a track shape. FIG. 9 shows a state of the magnetic fluid after ten days have elapsed since the magnetic fluids having a viscosity of 300 mPa·s was injected into the recesses A to C, respectively.

As shown in FIG. 9, in the recess A, the magnetic fluid creeps up at the corners due to surface tension, and leaks out to a surface of the block. Therefore, for example, when the front inner shape of the voice coil 83 shown in FIG. 8 is equivalent to the recess A, the magnetic fluid 27 flows out of the voice coil 83 to the diaphragm 82 and thus disperses because the diaphragm 82 is fixed to an end of the voice coil 83. As a result, the amount of the magnetic fluid 27 within the magnetic gap G3 decreases, so that a sound on a rear surface side of the diaphragm 82 which has been sealed by the magnetic fluid 27 leaks to the outside of the yoke 20 through a gap between the plate 81 and an inner surface of the voice coil 83 and further a gap between an outer surface of the voice coil 83 and an inner surface of the yoke 20. Particularly in a receiver of a mobile phone which utilizes a sound on the rear surface side of the diaphragm 82 as a reproduction sound, emission of a sound on the rear surface side of the diaphragm 82 through the sound hole H2 is suppressed because a portion near the sound hole H2 is pressed against an ear when the mobile phone is used. Therefore, when the magnetic fluid 27 flows out, a sound on the rear surface side of the diaphragm 82 leaking to the outside of the yoke 20 through the gap between the plate 81 and the inner surface of the voice coil 83 increases in volume, and a sound pressure level of a sound on the rear surface side of the diaphragm 82 through the sound hole H2 is considerably lowered.

Figure 10:
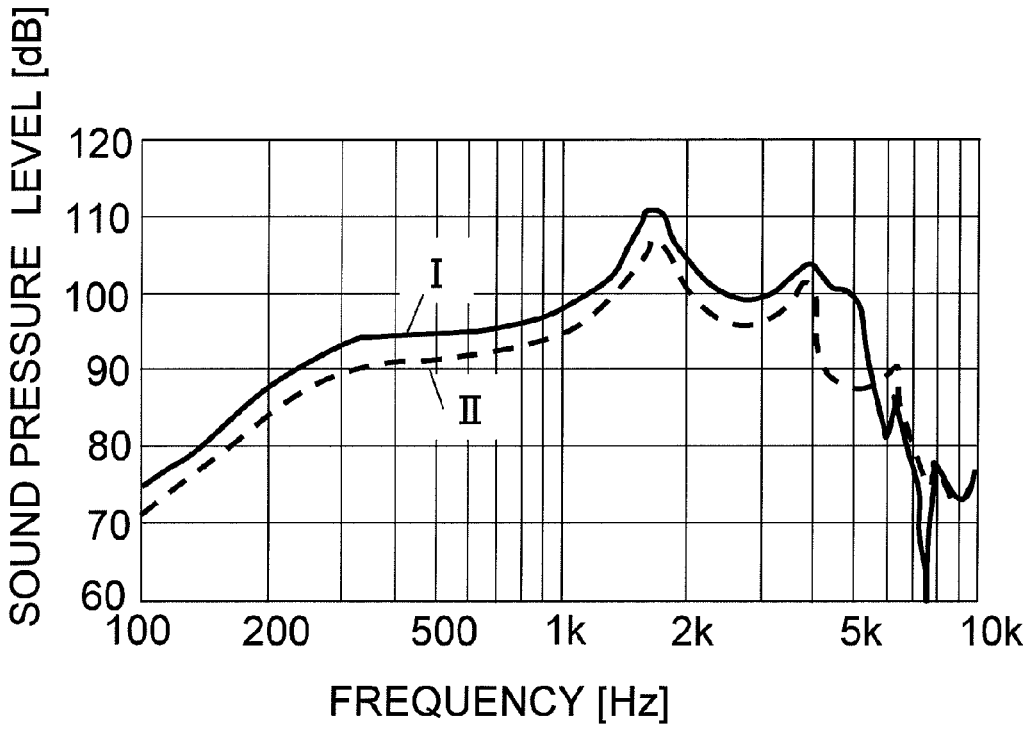
FIG. 10 shows coupler characteristics of a receiver having a rectangular voice coil with a corner radius R being 0.5.

FIG. 10 shows coupler characteristics of the receiver having a rectangular voice coil with a corner radius R=0.5 [mm] (i.e., when the front inner shape of the voice coil 83 is equivalent to the shape of the recess A). In FIG. 10, the reference character I indicates reproduction sound pressure level/frequency characteristics immediately after assembling, and the reference character II indicates reproduction sound pressure level/frequency characteristics ten days later. It can be seen from the characteristics II that creeping-up of the magnetic fluid has been observed and a sound pressure level is lowered by approximately 4 dB over the full range.

In the recess B, on the other hand, the magnetic fluid creeping up does not reach an upper surface of the block. In the recess C, creeping-up of the magnetic fluid is hardly observed. This is because a larger corner radius can reduce a degree of contact between the magnetic fluid and an inner wall surface of the recess. That is, by setting a corner radius R of the front inner shape of the voice coil to 1.0 [mm] or larger, creeping-up of the magnetic fluid from a corner can be prevented. As a result, a problem can be solved that a magnetic fluid creeps up from a magnetic gap over time to deteriorate sound pressure level characteristics.

As described above, according to the present embodiment, as compared with in Embodiment 2, the total thickness of the loudspeaker can be reduced, and a sound pressure level drop due to the magnetic fluid can be prevented.

In the above description, the edge pieces 24*a* and 24*b* are made of the same material as that of the diaphragm 82, but the present invention is not limited thereto. For example, the edge pieces 24*a* and 24*b* may be made of a material softer than the diaphragm 82. In this case, furthermore, the diaphragm 82 may be made of a material having high rigidity. In the above description, there is no mention of the material thickness of the edge pieces 24*a* and 24*b*, but the material thickness may be the same as that of the diaphragm 82 or may be smaller than that of the diaphragm 82. In the above description, the edge pieces 24*a* and 24*b* are formed integrally with the diaphragm 82, but the edge pieces 24*a* and 24*b* and the diaphragm 82 may be formed as separate pieces. In this case, the edge pieces 24*a* and 24*b* are joined to an outer circumferential end of the diaphragm 82 by bonding or welding.

In the above description, the rigidity of the diaphragm 82 is increased by forming the plurality of ribs L1 on the diaphragm 82, but the present invention is not limited thereto. For example, the rigidity may be increased by forming one rib L1 on the diaphragm 82. Alternatively, the rigidity may be increased for example by adopting, as an internal structure of the diaphragm 82, a sandwich structure in which a honeycomb-shaped core is sandwiched by plate-shaped surface materials.

Embodiment 9

Figure 11:
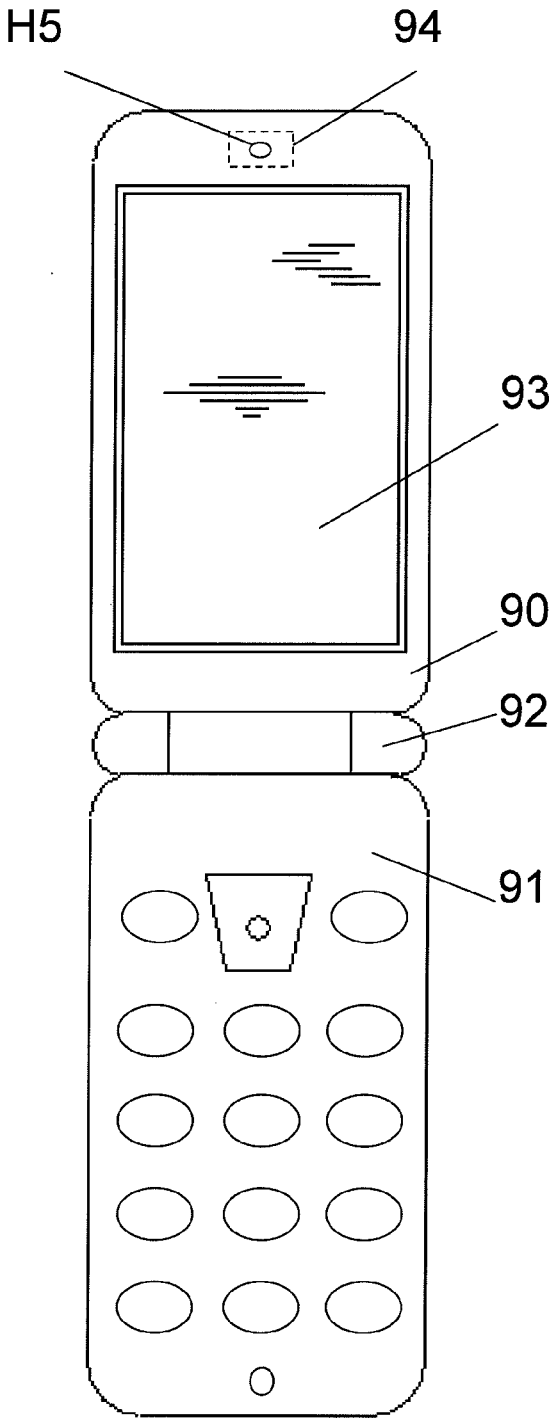
FIG. 11 is an external view of a mobile phone which is an example of a portable information processing apparatus according to Embodiment 9.

The present embodiment describes an example of the loudspeakers according to Embodiments 1 to 8 described above being installed in a portable information processing apparatus. FIG. 11 is an external view of a mobile phone which is an example of a portable information processing apparatus according to Embodiment 9.

In FIG. 11, the mobile phone is a foldable mobile phone, and mainly includes an upper housing 90, a lower housing 91, a hinge section 92, a liquid crystal screen 93, and a loudspeaker 94. The upper housing 90 and the lower housing 91 are connected to each other so as to be rotatable about the hinge section 92. The liquid crystal screen 93 is provided in the upper housing 90, and a sound hole H5 is formed above the liquid crystal screen 93. The loudspeaker 94 has the structure of any of the loudspeakers according to Embodiments 1 to 8 described above, and is disposed above the liquid crystal screen 93 and inside the upper housing 90. In the present embodiment, one example is taken where the loudspeaker 94 is a loudspeaker that reproduces a reception sound in the mobile phone, that is, the loudspeaker 94 is an acoustic transducer called a receiver. In a case where the loudspeaker 94 has the same structure as that of the loudspeaker according to Embodiment 6 shown in FIGS. 6(*a*) and 6(*b*) for example, the loudspeaker 94 is arranged in such a manner that the sound hole H4 or the sound hole H2 shown in FIG. 6(*b*) is connected to the sound hole H5 of the upper housing 90 shown in FIG. 11.

Operations and effects of the mobile phone configured as above will be described. A reception signal received by an antenna (not shown) is processed in a signal processing section (not shown), and then inputted to the loudspeaker 94 to be converted into a reception sound.

Here, in a general loudspeaker, reproduction sound pressure level/frequency characteristics of the loudspeaker are measured by a microphone that is provided at a predetermined distance from the loudspeaker. On the other hand, in a receiver which is a loudspeaker that reproduces a reception sound, reproduction sound pressure level/frequency characteristics of the loudspeaker are measured by an acoustic coupler mounted on the loudspeaker. Generally used as the acoustic coupler are three types of acoustic couplers called Type 1, Type 3.2 low-leak, or Type 3.2 hi-leak according to the ITU (International Telecommunication Union) standard. Provided within these acoustic couplers is a narrow space in which a microphone is mounted, and the microphone measures reproduction sound pressure level/frequency characteristics of the receiver.

When the Type 1 acoustic coupler is mounted in the receiver, the above-mentioned space within the acoustic coupler is completely closed. Therefore, measured reproduction sound pressure level/frequency characteristics of the receiver are flat in a low frequency range equal to or lower than the lowest resonance frequency of the receiver. In the mobile phone, on the other hand, a reception sound is heard by putting the sound hole H5 to an ear, and it is difficult to completely close a space between the upper housing 90 of the mobile phone and the ear. Thus, the two types of acoustic couplers, namely the Type 3.2 low-leak or the Type 3.2 hi-leak, in which a sound hole for leaking a sound from the space within the acoustic coupler to the outside is formed, are used for measuring reproduction sound pressure level/frequency characteristics of a receiver under near actual-use conditions in which a user is using a mobile phone. A sound hole in the Type 3.2 low-leak is small so that low volume of sound is leaked through the sound hole, and a sound hole in the Type 3.2 hi-leak is large so that high volume of sound is leaked through the sound hole. This leaking of sound through the sound hole occurs mainly in the low frequency range. Therefore, when the acoustic coupler of Type 3.2 is used, reproduction sound pressure level/frequency characteristics are exhibited with sound pressure level in the low frequency range being considerably lowered as compared with when the acoustic coupler of Type 1 is used. Of course, the hi-leak acoustic coupler exhibits a greater decrease in sound pressure level in the low frequency range than the low-leak acoustic coupler. In recent years, since the liquid crystal screen 93 of the mobile phone becomes larger, the receiver is installed in the vicinity of an upper outer frame of the upper housing 90. Below the receiver, the liquid crystal screen 93 forms a plane and thus there is no problem about closing between the receiver and an ear. Above the receiver, however, no plane is formed and it is difficult to close a space between the receiver and an ear. Therefore, a reception sound reproduced by the receiver is considerably leaked from above the receiver. This condition is close to a state where measurement is performed using the Type 3.2 hi-leak acoustic coupler. Meanwhile, in the fourth-generation mobile phone which will be released a few years later, transmission characteristics of a reception sound will be improved, and a reproduction range of low-frequency-range sounds will be largely expanded to provide a higher quality of reception sound, as compared with in the existing mobile phones.

Figure 12:
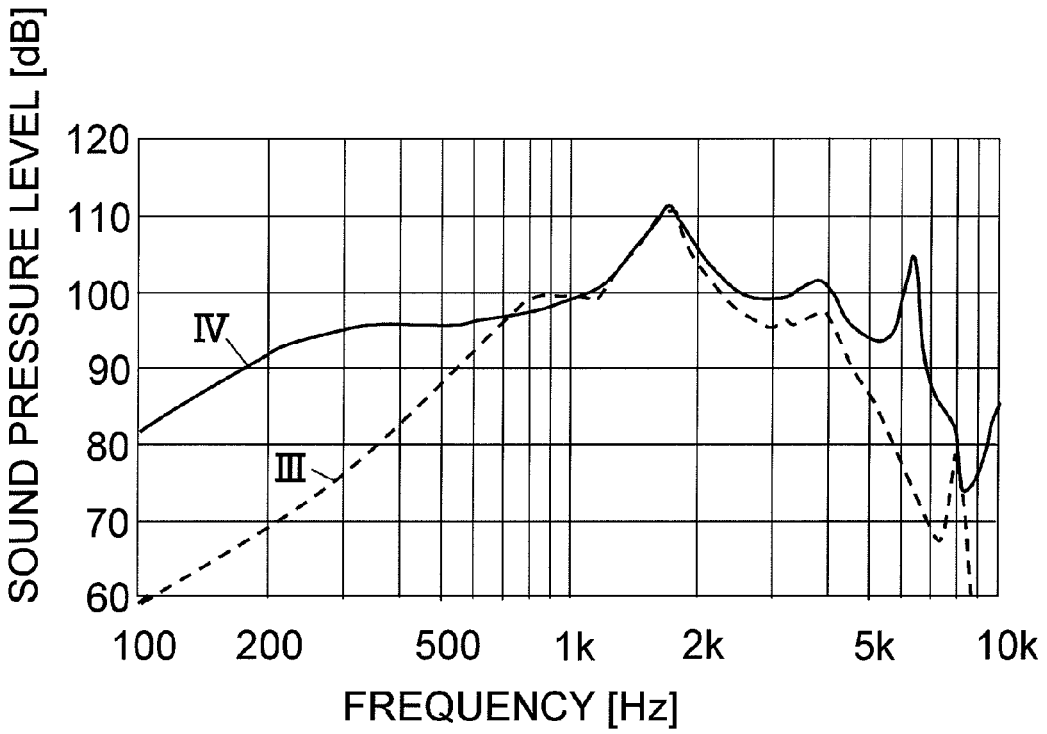
FIG. 12 shows a measurement result, using an acoustic coupler, of reproduction sound pressure level/frequency characteristics of a receiver.

Here, a measurement result, using an acoustic coupler, of reproduction sound pressure level/frequency characteristics of a receiver is shown in FIG. 12. FIG. 12 is a result of the Type 3.2 hi-leak acoustic coupler which exhibits a largest sound leak being used as the acoustic coupler. In FIG. 12, the reference character III indicates reproduction sound pressure level/frequency characteristics of a conventional receiver whose outer shape has a width of 5 [mm], a length of 10 [mm], and a thickness of 2.5 [mm] and whose lowest resonance frequency is 950 Hz, and the reference character IV indicates reproduction sound pressure level/frequency characteristics of a receiver whose outer shape is the same as that of the conventional receiver and which adopts the loudspeaker structure according to the present invention. Adopted as the loudspeaker structure according to the present invention is a structure in which two edge pieces are provided at each short side of a rectangle diaphragm obtained by shaping a PEN (polyethylenenaphthalate) film having a material thickness of 16 [μm] and in which a magnetic fluid having a viscosity of 100 mPa·s is loaded in a magnetic gap.

As seen from the characteristics IV shown in FIG. 12, by adopting the loudspeaker structure according to the present invention, the lowest resonance frequency can be lowered to 250 Hz so that a reproduction range of low-frequency-range sounds can be considerably expanded as compared with in the conventional receiver. For example, at 200 Hz, the sound pressure level can be raised by approximately 20 dB.

As described above, by adopting the loudspeaker structure according to the present invention as a receiver of a mobile phone, a quality of a reception sound can be considerably improved. That is, the loudspeaker structure according to the present invention is suitable for a receiver of a recent mobile phone in which the receiver should be installed in an upper portion of the upper housing 90 due to enlargement of the liquid crystal screen 93, and suitable for a receiver of the fourth-generation mobile phone in which a reproduction range of low-frequency-range sounds will be largely expanded.

Figure 13:
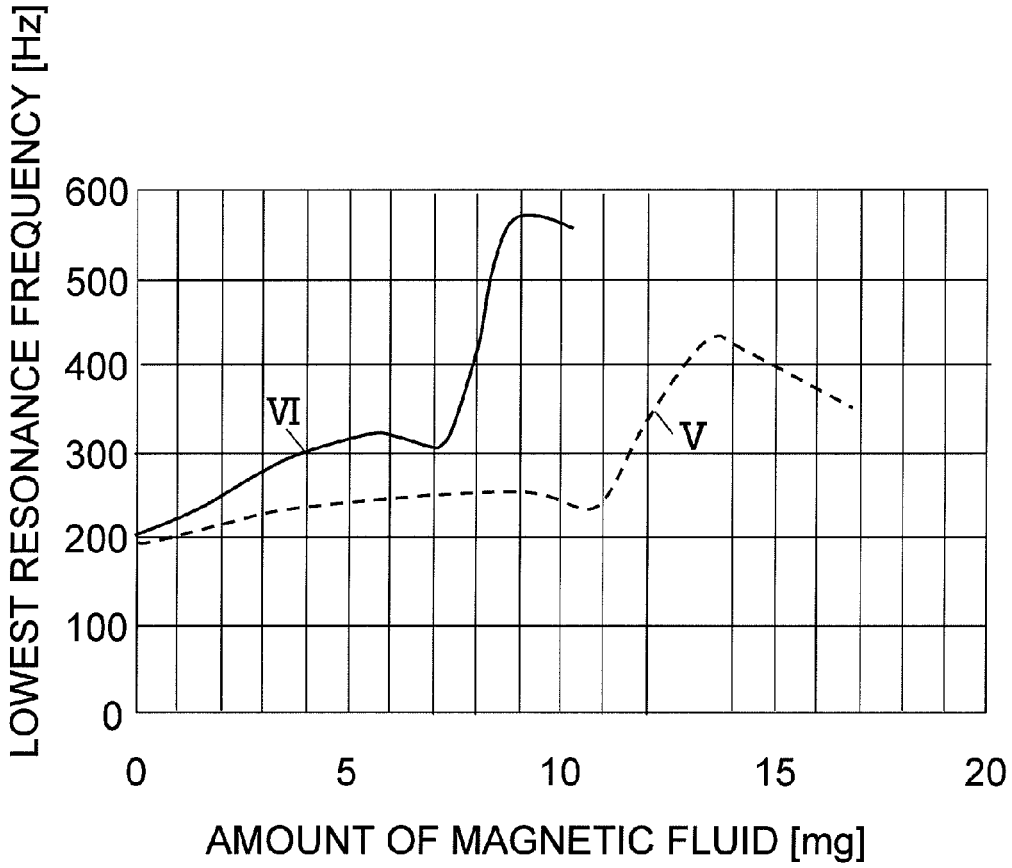
FIG. 13 shows a measurement result of a relationship between the amount and the viscosity of a magnetic fluid and the lowest resonance frequency.

Next, conditions of the viscosity and the amount of the magnetic fluid which is loaded within the magnetic gap will be described. In the loudspeaker structure according to the present invention, the voice coil is held within the magnetic gap due to the viscosity of the magnetic fluid as described above, and the viscosity and the amount of the magnetic fluid affect holding power for the voice coil. Particularly in a receiver of a mobile phone, a vibration system constituted of a diaphragm and a voice coil has a light weight of several tens mg. Therefore, the viscosity of the magnetic fluid raises the lowest resonance frequency of the receiver. FIG. 13 shows a measurement result of a relationship between the amount and the viscosity of a magnetic fluid and the lowest resonance frequency. In a measurement shown in FIG. 13, adopted as the loudspeaker structure according to the present invention is a structure in which a voice coil of ϕ6.5 is used, four edge pieces are provided at an outer circumferential portion of a diaphragm made of a PEN material having a material thickness of 16 μm, and the weight of a vibration system is 23 mg. In FIG. 13, the character V indicates a change in lowest resonance frequency along with a change in amount of magnetic fluid having a viscosity of 100 mPa·s, and the character VI indicates a change in lowest resonance frequency along with change in amount of magnetic fluid having a viscosity of 300 mPa·s. In the measurement shown in FIG. 13, the lowest resonance frequency in a magnetic-fluid-free state, which depends on the stiffness of the edge pieces and the weight of the vibration system, is 200 Hz. This frequency is defined as f1. The lowest resonance frequency in a state where a magnetic fluid is loaded is defined as f2.

With changing the amount of magnetic fluid having a viscosity of 100 mPa·s, when the amount of magnetic fluid exceeds 11 mg, f2 sees a sharp rise and exceeds 400 Hz, as seen from the characteristics V shown in FIG. 13. With changing the amount of magnetic fluid having a viscosity of 300 mPa·s, when the amount of magnetic fluid exceeds approximately 7.5 mg, f2 sees a sharp rise and becomes approximately 550 Hz. Here, as the lowest resonance frequency rises, the sound pressure level in the low frequency range of the receiver of the mobile phone drops, to narrow a reproduction range. Therefore, it is desirable that the viscosity and the amount of magnetic fluid are appropriately selected in such a manner that the lowest resonance frequency f1 in the magnetic-fluid-free state and the lowest resonance frequency f2 in the magnetic-fluid-loaded state satisfy a relationship of $f2/f1 \leq 2$.

Embodiment 10

Figure 14:
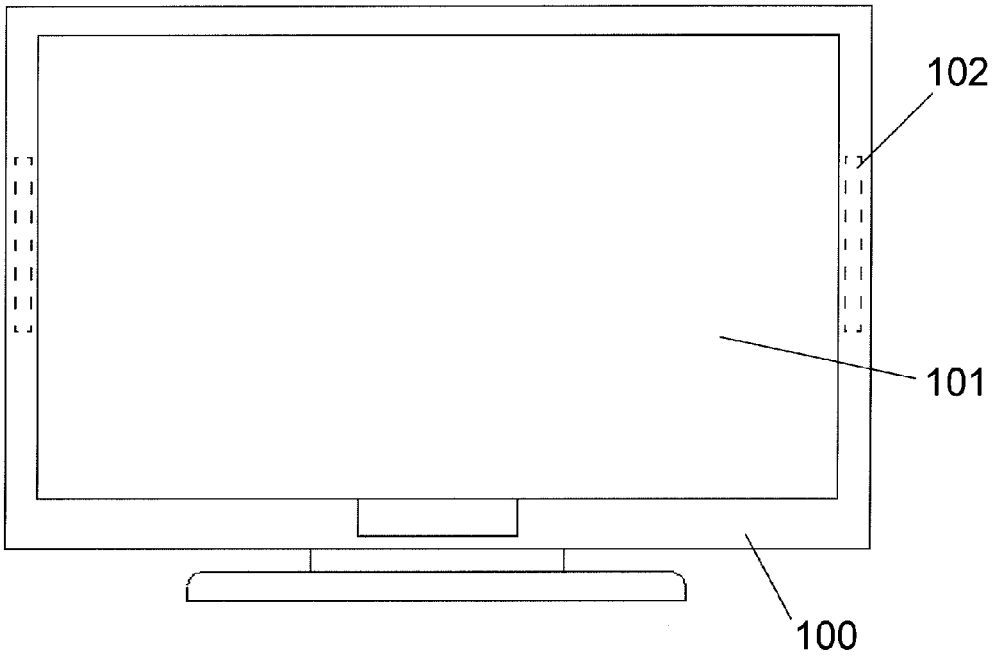
FIG. 14 is a front external view of a flat-screen television which is an example of a video device according to Embodiment 10.

The present embodiment describes an example of the loudspeakers according to Embodiments 1 to 8 described above being installed in a video device. FIG. 14 is a front external view of a flat-screen television which is an example of a video device according to Embodiment 10.

In FIG. 14, the flat-screen television mainly includes a housing 100, a display section 101, and loudspeakers 102. The display section 101 is formed by a PDP, a liquid crystal panel, or an organic EL panel, and provided in the housing 100. By way of example, the loudspeaker 102 has the structure of the loudspeaker according to Embodiment 7 shown in FIGS. 7(*a*) and 7(*b*), and is disposed within the housing 100 on each side of the display section 101. The loudspeaker 102 is disposed within the housing 100 so as to orient the diaphragm 23 shown in (b) of FIG. 7 toward a front of the flat-screen television.

Operations and effects of the flat-screen television configured as above will be described. An acoustic signal processed in a signal processing section (not shown) is inputted to each loudspeaker 102 to be converted into a sound.

A recent flat-screen television is more and more frame-narrowed by narrowing an outer frame, which is formed by the housing 100 enclosing an outer circumference of the display section 101, to a maximum extent in order to emphasize largeness of the display section 101. Therefore, a space for placing the loudspeaker 102 is narrow, and there is a demand for slimming the loudspeaker 102. If the conventional loudspeaker structure shown in FIG. 15 is employed in the loudspeaker 102, by using the butterfly damper 6 and the magnet 7, the loudspeaker 102 can be slimmed and a reproduction range can be widened, and moreover non-linear distortion by the support can be reduced, but deterioration in sound quality and an efficiency drop occur. On the other hand, if the structure of the loudspeaker according to Embodiment 7 shown in FIGS. 7(*a*) and 7(*b*) is employed in the loudspeaker 102, there is no need for using the butterfly damper 6 and the magnet 7 and therefore deterioration in sound quality and an efficiency drop can be prevented.

As described above, the loudspeaker structure according to the present invention is suitable for a loudspeaker of a flat-screen television which becomes slimmer and slimmer.

The loudspeakers according to Embodiments 1 to 8 described above are also applicable to an inner-ear headphone which is used for a portable player or the like. The inner-ear headphone has a problem that sound leak occurs to cause deficiency of low frequency sounds unless a space between a loudspeaker and a user's ear is closed by pressing the ear with a cushioning or the like. However, by applying the loudspeaker according to the present invention, sufficient low frequency sounds can be reproduced and a sufficient sound quality can be obtained even though some sound leak occurs when a user wears an inner-ear headphone. That is, it is not so necessary to press a user's ear with a cushioning or the like in order to obtain sufficient low-frequency-sound reproduction and a sufficient sound quality. Thus, an inner-ear headphone with excellent wearing comfort can be realized.

INDUSTRIAL APPLICABILITY

The loudspeaker according to the present invention is capable of realizing both of downsizing and widening of a reproduction range and reducing non-linear distortion by a support as well as further improving a sound quality and efficiency. The loudspeaker according to the present invention is installed in a video device such as a flat-screen television having a liquid crystal panel, a PDP, or an organic EL panel which becomes thinner and thinner, in a portable information processing apparatus such a mobile phone, and the like.

The invention claimed is:

1. A loudspeaker comprising:

a diaphragm;

a magnetic circuit that is provided on a rear side of the diaphragm and has a magnetic gap;

a voice coil that is directly or indirectly joined to the diaphragm along an outer shape of the diaphragm and extends into the magnetic gap; and a magnetic fluid that is disposed within the magnetic gap, wherein an inner shape of the voice coil, when viewed from a top view of the diaphragm, has at least two linear portions and at least two rounded portions, wherein a curvature radius of each of the rounded portions is 1 mm or larger, and wherein an outer shape of the diaphragm, when viewed from the top view thereof, is a rectangle.

2. The loudspeaker according to claim 1, wherein the inner shape of the voice coil, when viewed from the top view the diaphragm, is a rectangular shape with four of the linear portions and four of the rounded portions each having the curvature radius of 1 mm or larger.

3. The loudspeaker according to claim 1, wherein the inner shape of the voice coil, when viewed from the top view of the diaphragm, is a track shape with each of the rounded portions having the curvature radius of 1 mm or larger.

4. The loudspeaker according to claim 1, wherein the inner shape of the voice coil comprises four of the linear portions and four of the rounded portions rounded having the curvature radius of 1 mm or larger.

5. The loudspeaker according to claim 1, wherein the magnetic circuit comprises a yoke shaped as a container opening towards the diaphragm and including a bottom wall having an inner surface that faces the diaphragm, a plate that cooperates with the yoke to form the magnetic gap therebetween, and a magnet having a first surface fixed to the plate and a second surface, opposite to the first surface, fixed to the inner surface of the bottom wall of the yoke, wherein an outer shape of the plate, when viewed from the top view of the diaphragm, is a rectangular shape with corners, and wherein an outer shape of the magnet, when viewed from the top view of the diaphragm, is a rectangular shape with corners.

6. The loudspeaker according to claim 3, wherein the magnetic circuit comprises a yoke shaped as a container opening towards the diaphragm and including a bottom wall having an inner surface that faces the diaphragm, a plate that cooperates with the yoke to form the magnetic gap therebetween, and a magnet having a first surface fixed to the plate and a second surface, opposite to the first surface, fixed to the inner surface of the bottom wall of the yoke, wherein an outer shape of the plate, when viewed from the top view of the diaphragm, is a track shape, and wherein an outer shape of the magnet, when viewed from the top view of the diaphragm, is a track shape.

7. The loudspeaker according to claim 1, further comprising a plurality of first edge pieces provided at different positions at an outer portion of the diaphragm for vibratably supporting the diaphragm, each of the first edge pieces having a curved cross-sectional shape when viewed in a longitudinal cross-section taken along a central axis of the loudspeaker.

8. The loudspeaker according to claim 7, wherein the diaphragm and each of the first edge pieces are formed integrally with each other.

9. The loudspeaker according to claim 7, wherein the diaphragm and each of the first edge pieces are formed as separate pieces.

10. The loudspeaker according to claim 7, wherein an end of each of the first edge pieces, which is joined to the outer portion of the diaphragm, is positioned inside an outer circumferential end of the diaphragm.

11. The loudspeaker according to claim 7, wherein the first edge pieces are only provided at two short sides of the diaphragm.

12. The loudspeaker according to claim 11, wherein at each corner region of the diaphragm, when viewed from the top view of the diaphragm, a right angle is formed by the diaphragm where each of the two short sides of the diaphragm meets one of long sides of the diaphragm.

13. The loudspeaker according to claim 11, wherein an outer shape of each the first edge pieces, when viewed from a top view thereof, is a rectangular shape, and each of the first edge pieces has a long side that contacts one of the two short sides of the diaphragm.

14. The loudspeaker according to claim 11, wherein an outer shape of each of the first edge pieces, when viewed from a top view thereof, is a rectangular shape, and each of the first edge pieces has a long side that contacts one of the two short sides of the diaphragm at a position inside of the outer shape of the diaphragm where the voice coil is directly or indirectly joined, such that portions of the first edge pieces overlap portions of the diaphragm.

15. The loudspeaker according to claim 13, wherein the long sides of the first edge pieces are equal in length to the two short sides of the diaphragm.

16. The loudspeaker according to claim 14, wherein the long sides of the first edge pieces are equal in length to the two short sides of the diaphragm.

17. The loudspeaker of claim 1, wherein the magnetic circuit includes a magnet, the magnet having a sound hole passing through a center of the magnet.

* * * * *